US008638947B2

(12) United States Patent
Par

(10) Patent No.: US 8,638,947 B2
(45) Date of Patent: Jan. 28, 2014

(54) ANGLE-DEPENDENT OPERATING DEVICE OR METHOD FOR GENERATING A PSEUDO-STEREOPHONIC AUDIO SIGNAL

(75) Inventor: Clemens Par, Cinuos-chel (CH)

(73) Assignee: Stormingswiss GmbH, Morges (CH)

( * ) Notice: Subject to any disclaimer, the term of this patent is extended or adjusted under 35 U.S.C. 154(b) by 394 days.

(21) Appl. No.: 12/946,008

(22) Filed: Nov. 15, 2010

(65) Prior Publication Data

US 2011/0075850 A1 Mar. 31, 2011

Related U.S. Application Data

(63) Continuation of application No. PCT/EP2009/000339, filed on May 12, 2009.

(30) Foreign Application Priority Data

May 13, 2008 (EP) ..... 08008832

(51) Int. Cl.
*H04R 5/00* (2006.01)

(52) U.S. Cl.
USPC ..... 381/17; 381/26; 381/19; 381/307

(58) Field of Classification Search
USPC ..... 381/17, 18, 1, 122, 19, 26, 20, 97, 104, 381/150, 300, 63, 56, 310, 61, 91, 307
See application file for complete search history.

(56) References Cited

U.S. PATENT DOCUMENTS

| | | | | |
|---|---|---|---|---|
| 5,173,944 | A | 12/1992 | Begault | |
| 5,671,287 | A | 9/1997 | Gerzon | |
| 6,636,608 | B1 | 10/2003 | Kishii et al. | |
| 7,440,575 | B2 * | 10/2008 | Kirkeby | 381/1 |
| 7,945,054 | B2 * | 5/2011 | Kim | 381/17 |
| 8,116,460 | B2 * | 2/2012 | Henn et al. | 381/23 |

FOREIGN PATENT DOCUMENTS

| | | | |
|---|---|---|---|
| EP | 0825800 | A2 | 2/1998 |
| EP | 1850639 | A1 | 10/2007 |

OTHER PUBLICATIONS

International Search Report for PCT/EP2009/003339, dated Sep. 10, 2009.

* cited by examiner

*Primary Examiner* — Vivian Chin
*Assistant Examiner* — Con P Tran
(74) *Attorney, Agent, or Firm* — Pearne & Gordon LLP

(57) ABSTRACT

An angle-dependent operating device and method for obtaining a pseudo-stereophonic audio signals, such as through the parameterization of a fictitious opening angle $\alpha+\beta$, where $\alpha$ is the fictitious left-hand opening angle (situated to the left of the main axis of the monophonic audio signal to be stereophonized), and $\beta$ is the fictitious right-hand opening angle (situated to the right of the main axis of the monophonic audio signal to be stereophonized), where it may be that $\alpha \neq \beta$. This is provided for the situation of fictitious opening angles $\alpha+\alpha$ which are asymmetric with respect to the principal axis of the monophonic audio signal to be stereophonized.

24 Claims, 12 Drawing Sheets

PRIOR ART

PRIOR ART

PRIOR ART

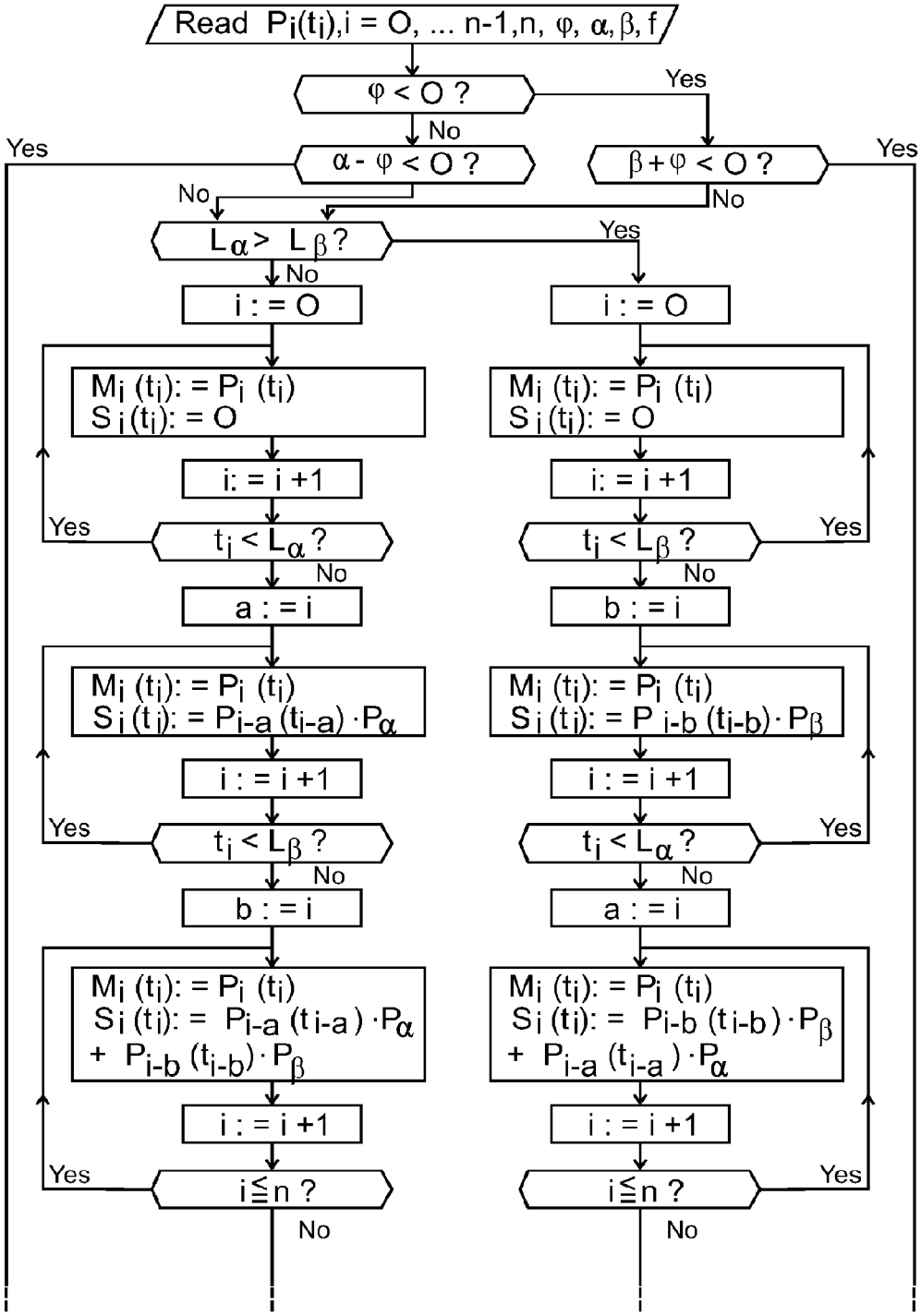
Fig. 19.1

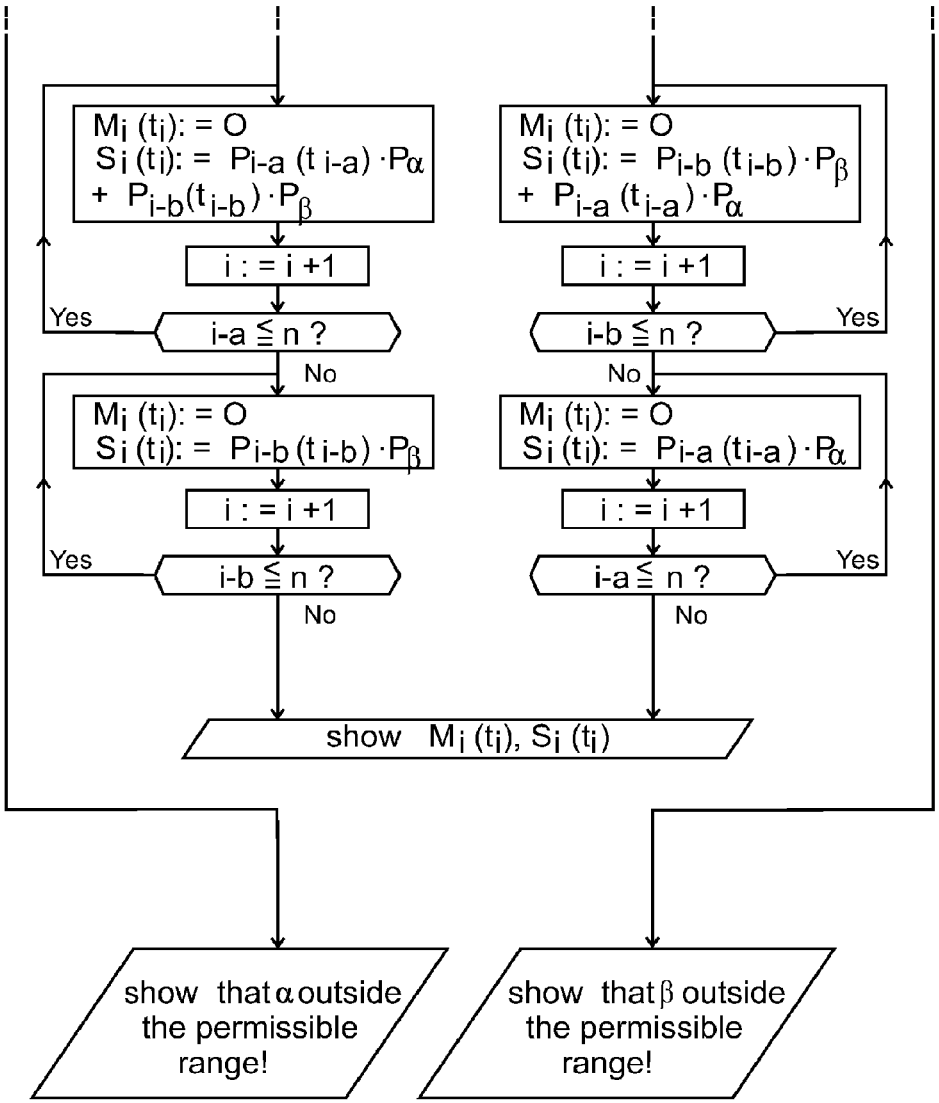
Fig. 19.2

ANGLE-DEPENDENT OPERATING DEVICE OR METHOD FOR GENERATING A PSEUDO-STEREOPHONIC AUDIO SIGNAL

REFERENCE DATA

The present application is a continuation of international PCT application PCT/EP2009/00339 (WO2009/138205) filed on May 12, 2009, the contents of which are hereby incorporated, and which claims priority from European patent application EP08008832 of May 13, 2009, the contents whereof are hereby incorporated.

TECHNICAL FIELD

The invention relates to audio signals (particularly sound transducer signals) and to apparatuses and methods for the obtainment, transmission, transformation and reproduction thereof.

BACKGROUND OF THE INVENTION

Generally, such systems attempt to depict or suggest three-dimensional information which the human ear is able to break down. This can be achieved by the reproduction of two or more differently constituted final signals, by the addition of artificial early reflections or artificial diffuse sound or by the simulation of audio circumstances relating to the human head by means of HRTF, alternatively. These approaches to a solution are used particularly in order to convert monophonic audio signals into audio signals which convey to the ear an actual or fictitious three-dimensionality. Such methods are referred to as "pseudo-stereophonic".

In comparison with conventional stereo signals, pseudo-stereophonic signals usually exhibit deficiencies. In particular, psychoacoustic reasons mean that the localizability of the sound sources, for example in the case of methods which distribute the frequency spectrum with different phase shifts over the final signals, is restricted. The application of propagation time differences also normally results in inconsistent localization for the same reasons. Artificial reverberation, likewise for psychoacoustic reasons, prompts fatigue phenomena in the listener. A series of proposals have been made, particularly by Gerzon (see below), which are intended to eliminate such inconsistencies in the stereophonic depiction of sound sources. Reproduction of the original three-dimensional circumstances, as conventional stereo signals aim to depict, does not usually occur even in complex applications, however.

In particular, pseudo-stereophony based on the simulation of intensity-stereophonic methods has the particular problem that a monophonic audio signal based on a figure-of-eight directivity pattern cannot be stereophonized, on account of the nondepiction of sound which is incident from the side.

The prior art is formed by the following documents:

U.S. Pat. No. 5,173,944 considers signals, obtained at constant azimuth of 90 degrees, 120 degrees, 240 degrees and 270 degrees by means of HRTF from the differently delayed but uniformly amplified fundamental signal, which are overlaid on the fundamental signal. In this case, level and propagation time corrections remain independent of the original recording situation.

U.S. Pat. No. 6,636,608 proposes phase shifts, determined on the basis of frequency, in the mono signal to be stereophonized which are overlaid on the original monophonic audio signal both in the left-hand and in the right-hand channel with different gains—which are likewise independent of the recording situation!

The aforementioned document U.S. Pat. No. 5,671,287 (Gerzon) improves a method proposed by Orban (which takes a monophonic audio signal and obtains a summed signal and a difference signal which have frequency-dependent phase shifts—regardless of the recording situation!), these improvements likewise being based on frequency-dependent phase shifts or on a gain—regardless of the recording situation!—given slightly altered formation of the summed and difference signals.

The applicant's own European application No. 06008455.5 proposes methodical consideration of the manually or metrologically ascertained angle $\phi$ between main axis and sound source using propagation time and level differences which are dependent on the angle $\phi$. If the angle $\phi$ is equal to zero, however, compatible stereophonic depiction is not possible.

The invention explained below is intended to be a significant improvement in the stereophonic reproduction of a monophonic depicted sound source, taking account of the recording situation. In addition, a reliable method of stereophonization is intended to be provided for the aforementioned figure-of-eight directivity pattern, which has to date been problematical for intensity-stereophonic simulations. Subsequently, the aim is to allow compatible stereophonic depiction even for the case in which the angle $\phi$ between main axis and sound source is equal to zero.

The subject matter of the invention can be presented as follows:

The technical solution-proposed in the applicant's own European application No. 06008455.5—of methodical consideration of the angle $\phi$ between main axis and sound source using propagation time and level differences which are dependent on the angle $\phi$involves MS matrixing, where the following relationships apply to input signals M and S and resultant signals L and R:

$$L = (M + S) * \frac{1}{\sqrt{2}} \tag{1}$$

$$R = (M - S) * \frac{1}{\sqrt{2}} \tag{2}$$

The classic S signal-which is specific to MS engineering—has a figure-of-eight directivity pattern, said signal being offset from the M signal by 90 degrees to the left. If the level of the S signal is now increased in comparison with the M signal, what is known as the opening angle $2\alpha$ (which is obtained from the points of intersection of the overlapping polar diagrams for the M system and the S system and—like the figure-of-eight directivity pattern of the S system—is always situated symmetrically with respect to the main axis of the M signal) is reduced to an increasing extent.

In a first step, it is possible to parameterize a fictitious opening angle $2\alpha$ even in an arrangement or a method which takes account of the angle $\phi$ between the main axis of the monophonic signal and the sound source. The calculated simulated side signal is then dependent both on the angle $\phi$ and on half the fictitious opening angle $\alpha$.

In a second step, gain factors are applied only to the signals which produce the side signal when summed.

In a third step, the angle-dependent polar interval f describing the directivity pattern of the M signal is parameterized. It is therefore now possible to stereophonize monophonic signals of arbitrary directivity pattern taking account of a fictitious opening angle 2α.

DISCLOSURE OF THE INVENTION

The invention involves the parameterization of a fictitious opening angle α+β. In this case, α is the fictitious left-hand opening angle (situated to the left of the main axis of the monophonic audio signal to be stereophonized), β is the fictitious right-hand opening angle (situated to the right of the main axis of the monophonic audio signal to be stereophonized), where it may be that α≠β. Thus, we are looking at the case—which does not arise in classic MS matrixing—of possible fictitious opening angles α+β which are asymmetric with respect to the main axis of the monophonic audio signal to be stereophonized.

Accordingly, the trigonometrically ascertained level and propagation time differences for the simulated side signal are made dependent not only on ϕ and f but also on the fictitious left-hand opening angle α and on the fictitious right-hand opening angle β, wherein—if the sound source can be classified as being to the left of the main axis—the relationship ϕ≤α must apply or—if the sound source can be classified as being to the right of the main axis—the relationship ϕ≤β must apply. In all cases, zero or a region around zero must be ruled out for α and β, since the level and propagation time differences calculated by parameterizing α and β converge toward infinity, that is to say are technically infeasible.

Suitable selection of α and βcan therefore be used to attain stereophonic depiction of a monophonic audio signal, which usually affords more favorable conditions than methods which omit parameterization of a fictitious opening angle α and β. In particular, a compatible stereophonic resolution is also possible for the case in which ϕ is equal to zero. α and β can be chosen as desired subject to the above conditions or can be determined by a suitable algorithm as appropriate.

Trigonometrically, the following delay times L(α), L(β) and gain factors P(α), P(β) (which, in order to allow unrestricted selection of ϕ, f and α and β, can be applied to the signals S(α) and S(β) which produce the simulated side signal S) are obtained for the angle ϕ, the angle-dependent polar interval f describing the directivity pattern of the M signal and the angles α and β:

$$L_\alpha = -\frac{f(\alpha)}{2\sin\alpha} + \sqrt{\frac{f^2(\alpha)}{4\sin^2\alpha} + f^2(\varphi) - \frac{f(\alpha)}{\sin\alpha} * f(\varphi) * \sin\varphi} \tag{3}$$

$$L_\beta = -\frac{f(\beta)}{2\sin\beta} + \sqrt{\frac{f^2(\beta)}{4\sin^2\beta} + f^2(\varphi) + \frac{f(\beta)}{\sin\beta} * f(\varphi) * \sin\varphi} \tag{4}$$

$$P_\alpha = \frac{f^2(\alpha)}{4\sin^2\alpha} + f^2(\varphi) - \frac{f(\alpha)}{\sin\alpha} * f(\varphi) * \sin\varphi \tag{5}$$

$$P_\beta = \frac{f^2(\beta)}{4\sin^2\beta} + f^2(\varphi) + \frac{f(\beta)}{\sin\beta} * f(\varphi) * \sin\varphi \tag{6}$$

A simplification for apparatuses and methods which make use of the subject matter of the invention is the suggestion that the discriminants of L(α) and L(β) can be used directly for ascertaining P(α) and P(β). This significantly simplifies schematic diagrams and algorithms, which means miniaturization of the relevant hardware at the highest efficiency.

Particularly for the aforementioned problems of stereophonization of a monophonic audio signal with a figure-of-eight directivity pattern, the following solution is derived, on the basis of the polar interval f(ψ)=cos ψ, which describes the figure-of-eight directivity pattern of the M signal and which is dependent on the polar angle ψ:

$$L_\alpha = -\frac{\cos\alpha}{2\sin\alpha} + \sqrt{\frac{\cos^2\alpha}{4\sin^2\alpha} + \cos^2\varphi - \frac{\cos\alpha}{\sin\alpha} * \cos\varphi * \sin\varphi} \tag{7}$$

$$L_\beta = -\frac{\cos\beta}{2\sin\beta} + \sqrt{\frac{\cos^2\beta}{4\sin^2\beta} + \cos^2\varphi + \frac{\cos\beta}{\sin\beta} * \cos\varphi * \sin\varphi} \tag{8}$$

$$P_\alpha = \frac{\cos^2\alpha}{4\sin^2\alpha} + \cos^2\varphi - \frac{\cos\alpha}{\sin\alpha} * \cos\varphi * \sin\varphi \tag{9}$$

$$P_\beta = \frac{\cos^2\beta}{4\sin^2\beta} + \cos^2\varphi + \frac{\cos\beta}{\sin\beta} * \cos\varphi * \sin\varphi \tag{10}$$

For the subject matter of the invention, it remains characteristic that the resultant MS signals finally need to be subjected to stereo decoding in accordance with formulae (1) and (2). A classic stereo signal is the result.

With the inclusion of apparatuses and methods which represent the prior art, it is otherwise possible to use the subject matter of the invention to obtain signals which provide stereophonic information via more than two loudspeakers (such as the surround-sound systems which are part of the prior art).

BRIEF DESCRIPTION OF THE FIGURES

Embodiments and exemplary applications of the present invention are explained by way of example with reference to the following figures.

is not equal to zero or an element of a region around zero.

Figure 15:
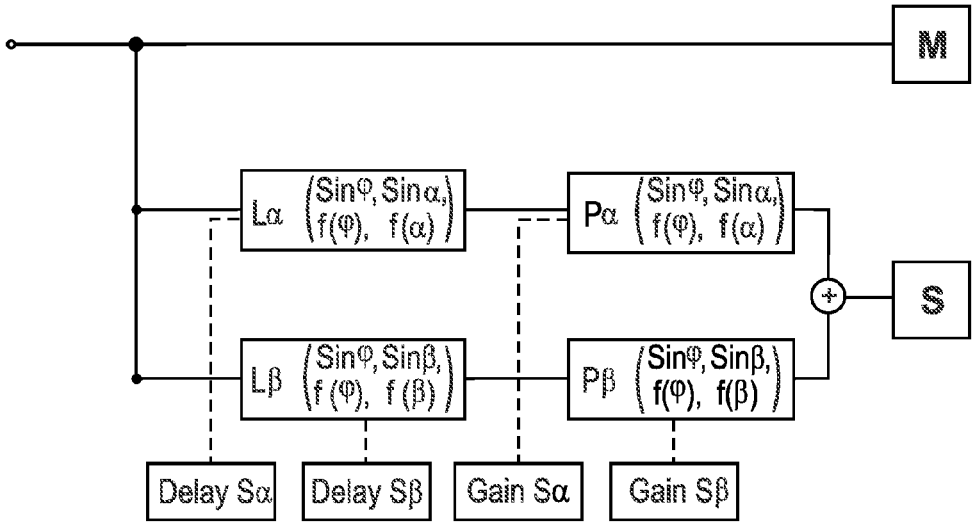
FIG. 15 shows a circuit based on the subject matter of the invention which takes account of the recording angle ϕ, of a left-hand fictitious opening angle α, of a right-hand fictitious opening angle β and of an angle-dependent polar interval f describing the directivity pattern of the M signal in order to convert a monophonic audio signal into MS signals which can be stereophonized.
Figure 17:
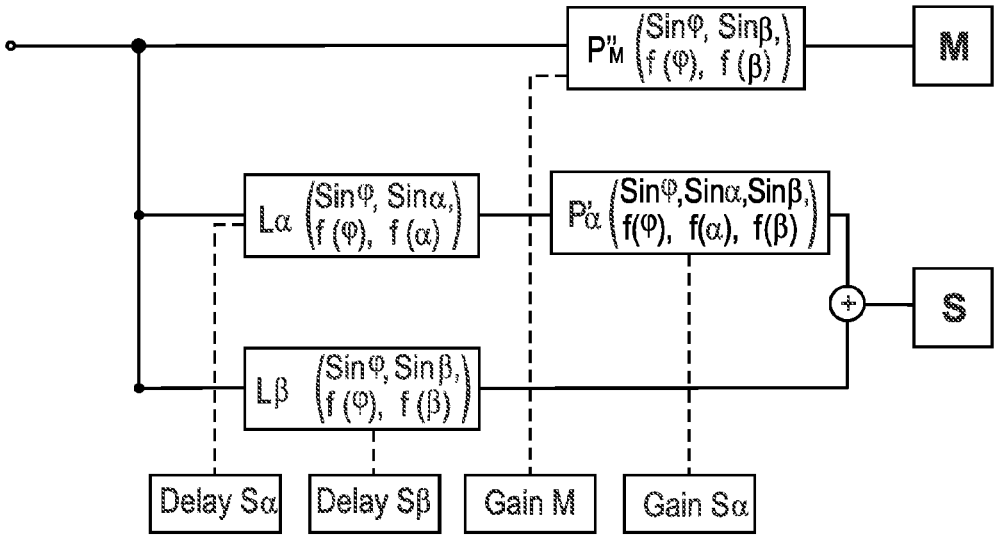

FIG. 17 shows a further variant for the circuit in FIG. 15, wherein for the recording angle ϕ, the right-hand fictitious opening angle β and the angle-dependent polar interval f describing the directivity pattern of the M signal it must be true that the expression $$\frac{f^2(\beta)}{4\sin^2\beta} + f^2(\varphi) + \frac{f(\beta)}{\sin\beta} * f(\varphi) * \sin\varphi \tag{12}$$

is not equal to zero or an element of a region around zero.

Figure 18:
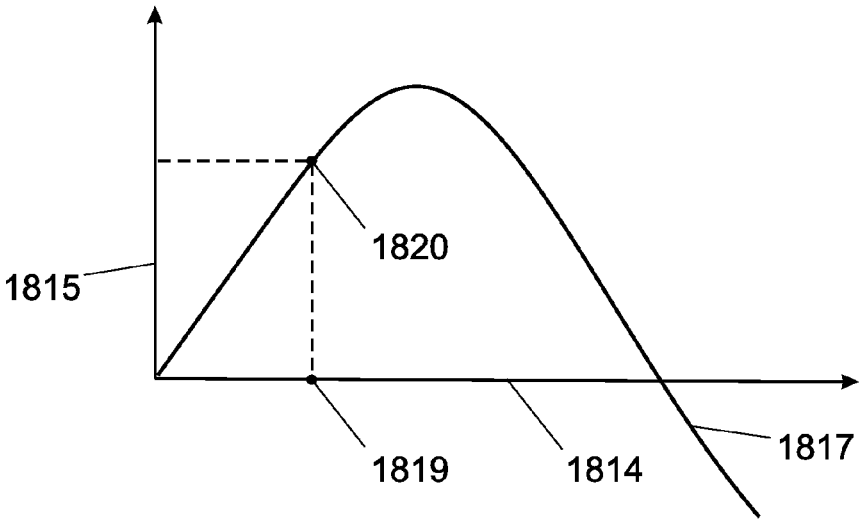

FIG. 18 shows the parameters $t_i$, $P_i(t_1)$ from FIG. 19.

FIG. 19 shows the flowchart for a method based on the subject matter of the invention which takes account of the recording angle ϕ, of a left-hand fictitious opening angle α, of a right-hand fictitious opening angle β and of an angle-dependent polar interval f describing the directivity pattern of the M signal, given sufficiently small intervals $[t_i, t_{i+1}]$, in order to convert a monophonic audio signal into MS signals which can be stereophonized.

DETAILED EMBODIMENTS AND EXEMPLARY APPLICATIONS OF THE INVENTION

Figure 1:
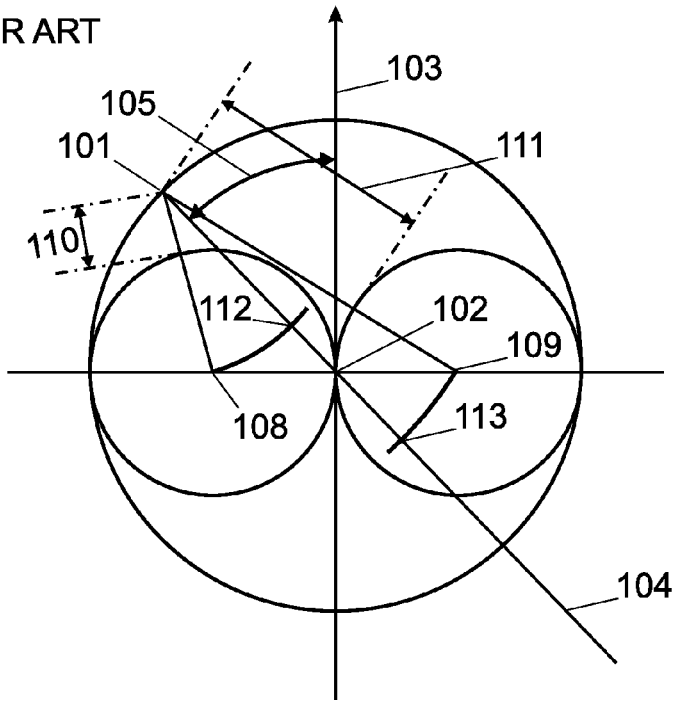
Fig. 1 PRIOR ART
FIG. 1 shows the operating principle of European Application No. 06008455.5.

The prior art for the operating principle of an apparatus or a method for stereophonizing a monophonic signal having an omnidirectional directivity pattern is outlined in FIG. 1: a sound source 101 is recorded beneath position 102 by a microphone having an omnidirectional directivity pattern, with the main axis 103 and the directional axis 104 of the sound source forming the angle ϕ (105). 108 and 109 illustrate the geometric positioning of those two simulated signals which produce the simulated side signal when summed. The propagation time difference in comparison with the mid signal for the simulated left-hand signal is 110, and the level of the simulated signal is ascertained from the level of the mid signal, multiplied by the square of the distance from 101 and 112 (level correction taking account of the sound level, which decreases with the square of the distance). The propagation time difference in comparison with the mid signal for the simulated right-hand signal is 111, and the level of the simulated signal is ascertained from the level of the mid signal, multiplied by the square of the distance from 101 and 113.

Figure 2:
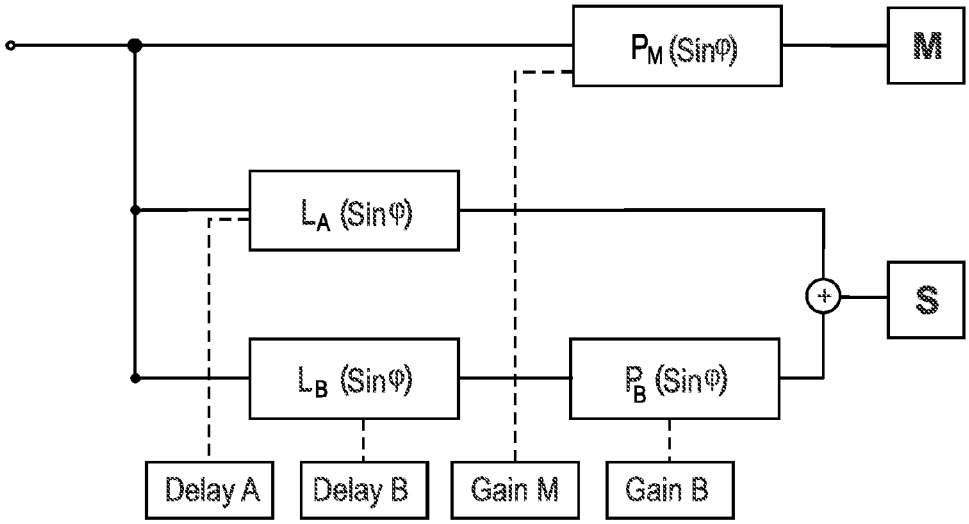
FIG. 2 shows a circuit which, in line with European Application No. 06008455.5, converts a monophonic audio signal into MS signals which can be stereophonized.

Reweighting the levels, which involves the input signal being associated directly with the simulated left-hand signal, produces the circuit diagram in FIG. 2 for a circuit which converts a monophonic input signal into MS signals which can be stereophonized. Ascertained trigonometrically, the following are obtained in this case for the propagation time differences $L_A$ and $L_B$ and the gain factors $P_A$ and $P_M$:

$$L_A = \sqrt{\frac{5}{4} - \sin\varphi} - \frac{1}{2} \tag{13}$$

$$L_B = \sqrt{\frac{5}{4} + \sin\varphi} - \frac{1}{2} \tag{14}$$

$$P_M = \frac{1}{\frac{5}{4} - \sin\varphi} \tag{15}$$

$$P_B = \frac{\frac{5}{4} + \sin\varphi}{\frac{5}{4} - \sin\varphi} \tag{16}$$

Figure 3:
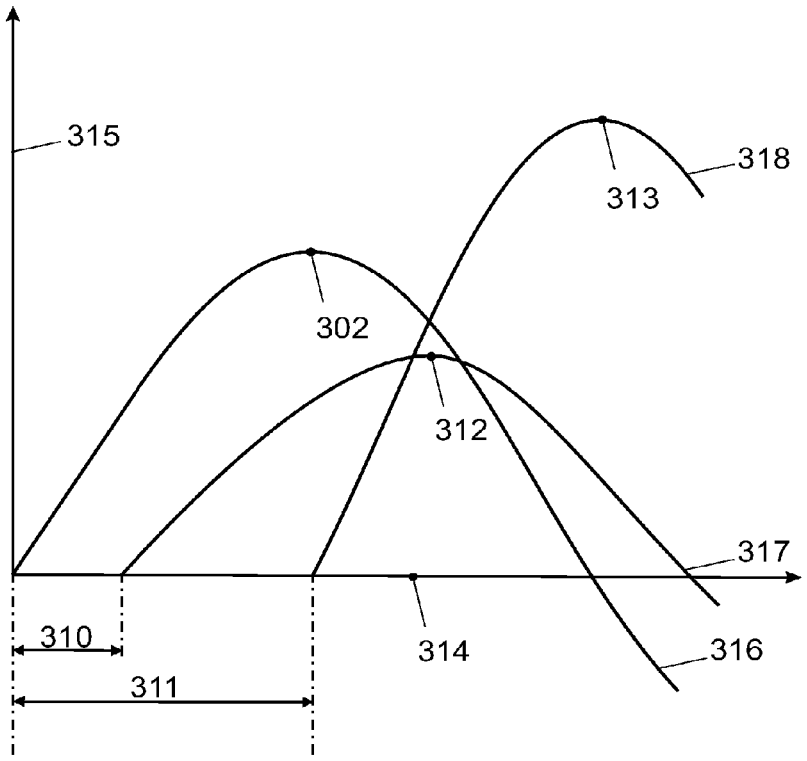
FIG. 3 depicts the internal signals in the circuit shown in FIG. 2.

The nature of the internally processed signals is shown in FIG. 3. The mid signal 316 is contrasted therein by two simulated signals 317 (with the delay time 310) and 318 (with the delay time 311) (where 314 is the time axis and 315 is the level axis). The maximum level point 302 is calculated from the maximum level point 312 on the basis of formula (15), and the maximum level point 313 is calculated on the basis of formula (16).

In order to derive apparatuses or methods operating on the basis of angle for the purpose of obtaining a pseudostereophonic audio signal, first of all the classic MS matrixing is considered for various half opening angles 2α and various directivity patterns of the M system. The symmetry of the S system with 90-degree rotation to the left with respect to the main axis of the M system means that an inherent feature of all methods is an opening angle 2α which is likewise arranged symmetrically with respect to the main axis and which is calculated from the points of intersection of the overlapping polar diagrams of the M system and the S system.

Figure 4:
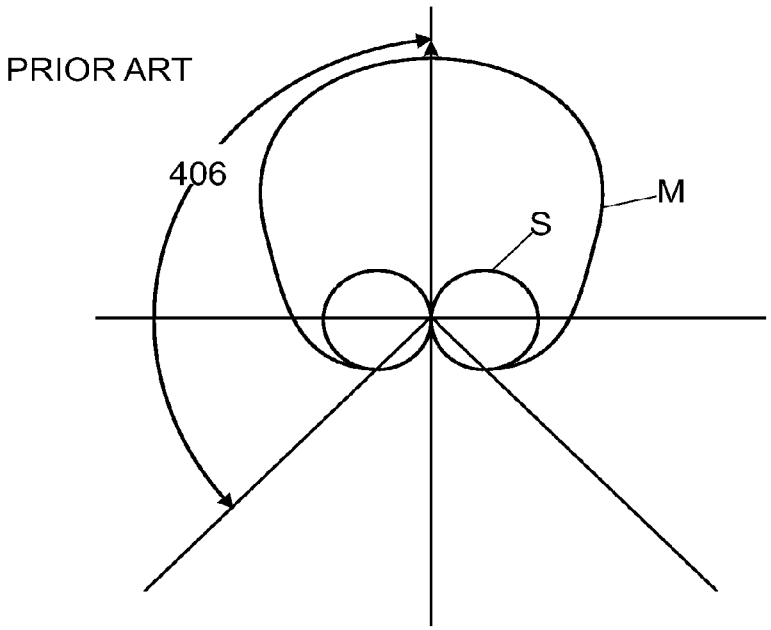
FIG. 4 shows a classic MS arrangement for the half opening angle α=135 degrees, comprising an M system with a cardioid directivity pattern and an S system with a figure-of-eight pattern.
Figure 5:
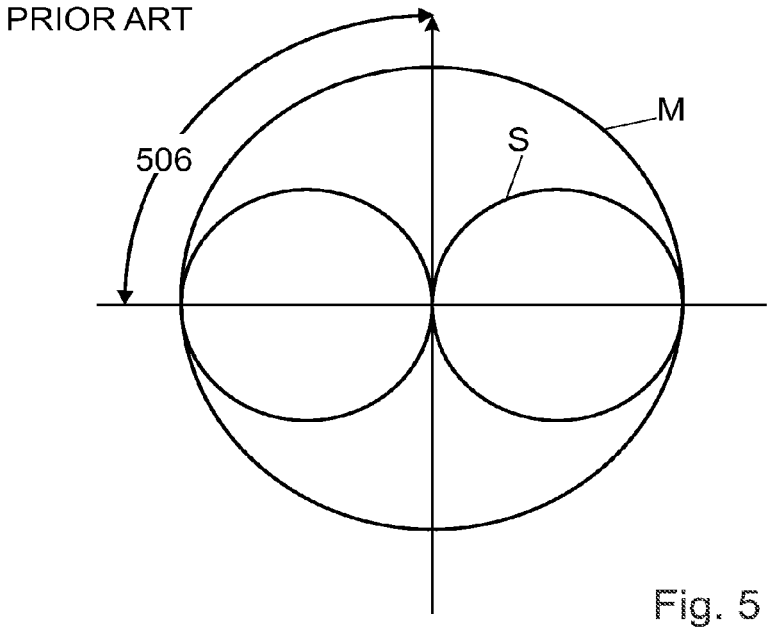
FIG. 5 shows a classic MS arrangement for the half opening angle α=90 degrees, comprising an M system with an omnidirectional directivity pattern and an S system with a figure-of-eight directivity pattern.
Figure 6:
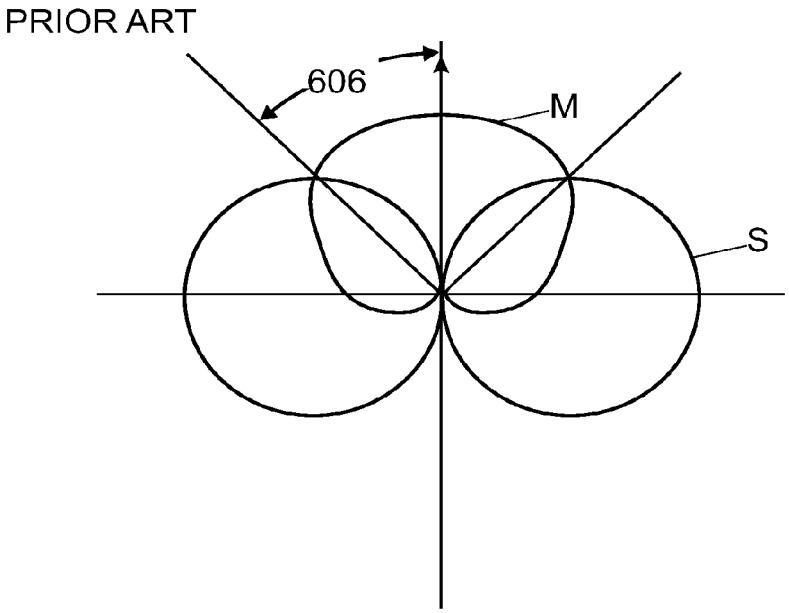
FIG. 6 shows a classic MS arrangement for the half opening angle α=53 degrees, comprising an M system with a cardioid directivity pattern and an S system with a figure-of-eight directivity pattern.
Figure 7:
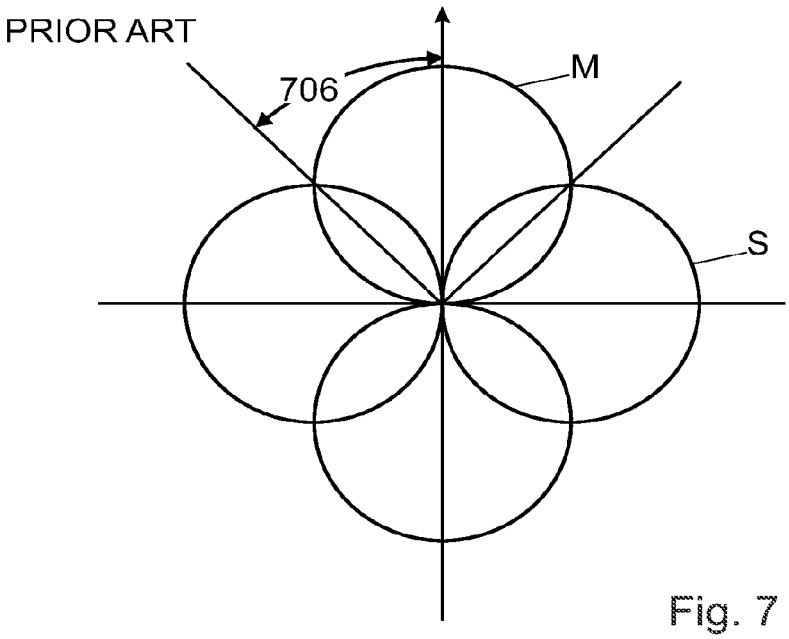
FIG. 7 shows a classic MS arrangement for the half opening angle α=45 degrees, comprising an M system with a figure-of-eight directivity pattern and an S system with a figure-of-eight directivity pattern.
Figure 8:
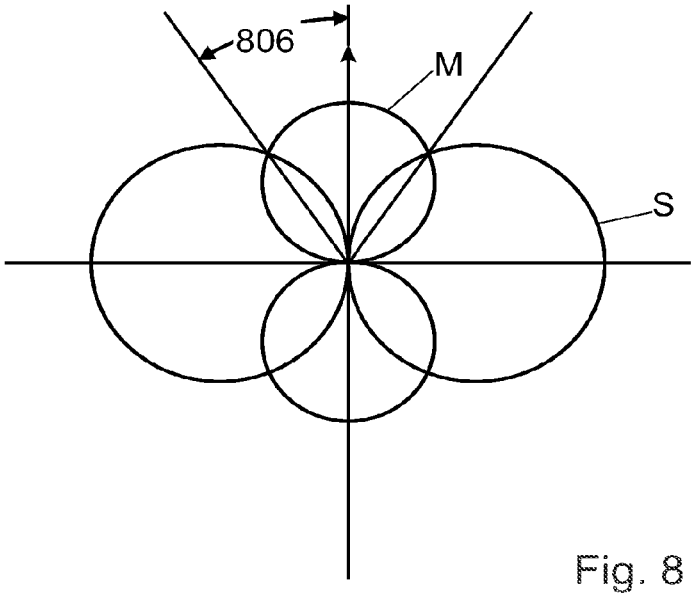
FIG. 8 shows a classic MS arrangement for the half opening angle α=33.5 degrees, likewise comprising an M system with a figure-of-eight directivity pattern and an S system with a figure-of-eight directivity pattern.

Thus, by way of example, FIG. 4 shows a classic MS arrangement for the half opening angle α (406) equal to 135 degrees, comprising an M system having a cardioid directivity pattern and an S system having a figure-of-eight directivity pattern. FIG. 5 shows a classic MS arrangement for the half opening angle α (506) equal to 90 degrees, comprising an M system having an omnidirectional directivity pattern and an S system having a figure-of-eight directivity pattern. FIG. 6 shows a classic MS arrangement for the half opening angle α (606) equals 53 degrees, comprising an M system having a cardioid directivity pattern and an S system having a figure-of-eight directivity pattern. FIG. 7 shows a classic MS arrangement for the half opening angle α (706) equals 45 degrees, comprising an M system having a figure-of-eight directivity pattern and an S system having a figure-of-eight directivity pattern. FIG. 8 shows a classic MS arrangement for the half opening angle α (806) equals 33.5 degrees, likewise comprising an M system having a figure-of-eight directivity pattern and an S system having a figure-of-eight directivity pattern.

Figure 9:
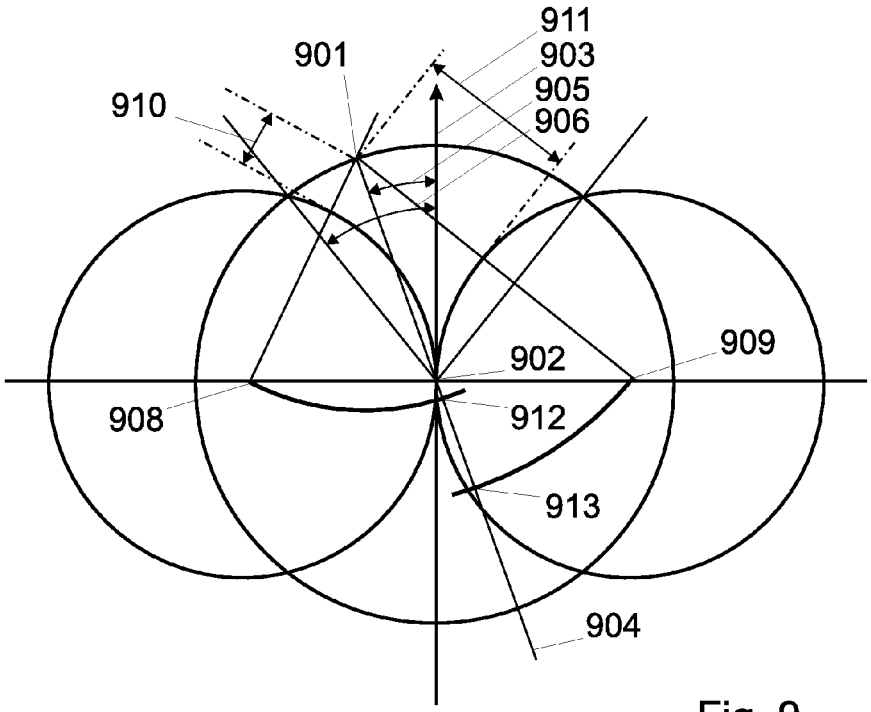
FIG. 9 shows an extension of the operating principle of European Application No. 06008455.5, in which a fictitious half opening angle α is also taken into account.

An extension of the operating principle derived from FIG. 1 is the additional consideration of a fictitious half opening angle α, as shown in FIG. 9: in this case, a sound source 901 is recorded by a mono microphone 902 having an omnidirectional directivity pattern, where the main axis 903 and the directional axis 904 of the sound source form the angle ϕ (905). Fresh consideration is given to the fictitious half opening angle α (906). This and the directivity pattern of the mid signal are used to directly derive the geometric positioning 908 of the simulated left-hand signal $S_A$ and the geometric positioning 909 of the simulated right-hand signal $S_B$, which produce the simulated side signal when summed. The propagation time difference in comparison with the mid signal for the simulated left-hand signal is 910, and the level of the simulated signal is ascertained from the level of the mid signal, multiplied by the square of the distance from 901 and 912 (level correction taking account of the sound level, which decreases with the square of the distance). The propagation time difference in comparison with the mid signal for the simulated right-hand signal is 911, and the level of the simulated signal is ascertained from the level of the mid signal, multiplied by the square of the distance from 901 and 913.

Figure 10:
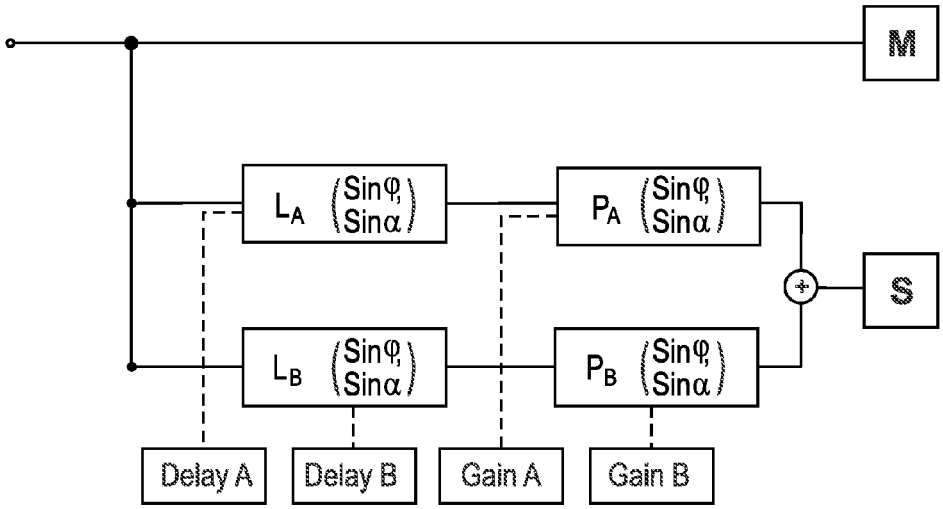
FIG. 10 shows a circuit which converts a monophonic audio signal into MS signals, which can be stereophonized, taking account of a fictitious half opening angle α.

The associated circuit, which has been slightly modified in comparison with the circuit in FIG. 2, is provided by FIG. 10, which takes account of the fictitious half opening angle α in order to convert a monophonic audio signal into MS signals which can be stereophonized. In this case, the following relationships apply to the propagation time differences $L_A$ and $L_B$ and the gain factors $P_A$ and $P_B$:

$$L_A = -\frac{1}{2\sin\alpha} + \sqrt{\frac{1}{4\sin^2\alpha} + 1 - \frac{\sin\varphi}{\sin\alpha}} \tag{17}$$

$$L_B = -\frac{1}{2\sin\alpha} + \sqrt{\frac{1}{4\sin^2\alpha} + 1 + \frac{\sin\varphi}{\sin\alpha}} \tag{18}$$

$$P_A = \frac{1}{4\sin^2\alpha} + 1 - \frac{\sin\varphi}{\sin\alpha} \tag{19}$$

$$P_B = \frac{1}{4\sin^2\alpha} + 1 + \frac{\sin\varphi}{\sin\alpha} \tag{20}$$

Figure 11:
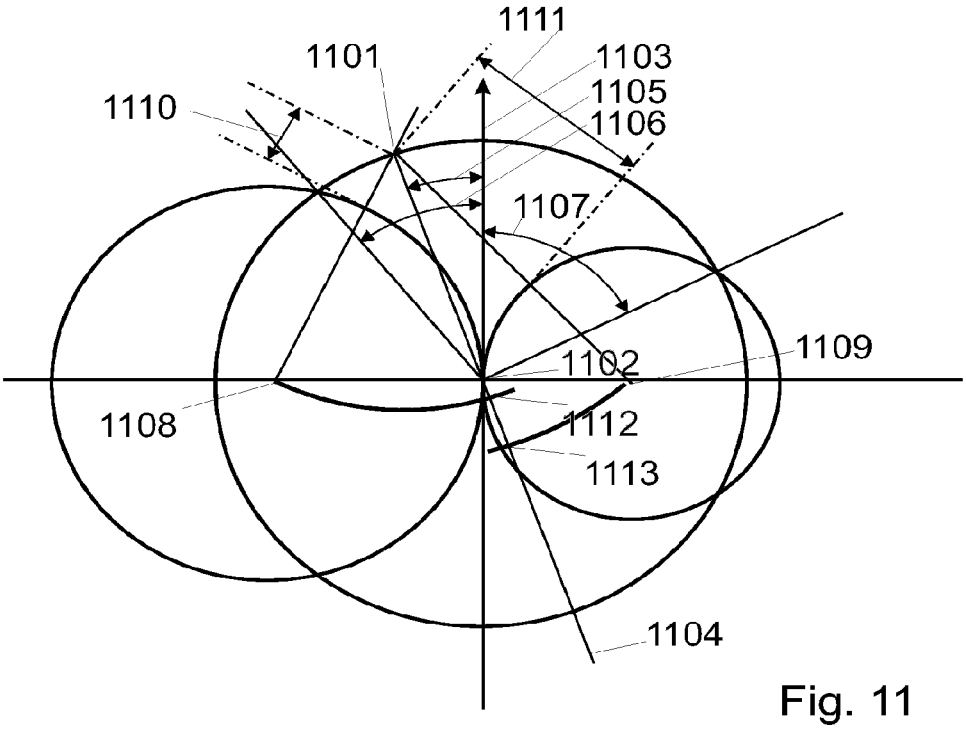
FIG. 11 shows an example of the operating principle of the invention for a signal with an omnidirectional directivity pattern which also takes account of a left-hand fictitious opening angle α and a right-hand fictitious opening angle β, which cannot arise in a classic MS arrangement on account of the use of a system with 90 degrees rotation to the left which is symmetrical with respect to the main axis and which has a figure-of-eight directivity pattern for the S signal.

Application of the subject matter of the invention to a mid signal having an omnidirectional directivity pattern:

A first exemplary application of the invention, based on a monophonic audio signal having an omnidirectional directivity pattern, is shown in FIG. 11. In this case, in line with the invention, a fictitious opening angle α+α is parameterized, where α is the fictitious left-hand opening angle 1106 (situated to the left of the main axis of the monophonic audio signal to be stereophonized), β is the fictitious right-hand opening angle 1107 (situated to the right of the main axis of the monophonic audio signal to be stereophonized)—that is to say angles which cannot arise at all in a classic MS arrangement on account of the use of an S system having a figure-of-eight directivity pattern which has 90-degree rotation to the left and which is symmetrical with respect to the main axis.

The subject matter of the invention accordingly leads to the consideration regarding the main axis of the monophonic audio signal to be stereophonized with possibly asymmetric fictitious opening angles α+β.

Considered in detail, the arrangement comprises a sound source 1101 which is recorded by a mono microphone 1102 having an omnidirectional directivity pattern, wherein the microphone main axis 1103 and the directional axis 1104 of the sound source form the angle ϕ (1105). Subsequently, a fictitious left-hand opening angle α is parameterized (1106) and also a fictitious right-hand opening angle β (1107), wherein—if the sound source can be classified as being to the left of the main axis—the relationship ϕ≤α must apply or—if the sound source can be classified as being to the right of the main axis—the relationship ϕ≤β must apply. Furthermore, in all cases, zero or a region around zero must be ruled out for α and β (since the levels and propagation time differences calculated trigonometrically by parameterizing α and β converge toward infinity, that is to say are technically infeasible).

Alpha, together with the directivity pattern of the mid signal, now determines exactly the geometric positioning 1108 of the simulated left-hand signal S(α), and β, together with the directivity pattern of the mid signal, determines exactly the geometric positioning 1109 of the simulated right-hand signal S(β), which produce the simulated side signal when summed. The propagation time difference L(α) in comparison with the mid signal for the simulated right-hand signal is 1110, and the level P(α) of the simulated signal is ascertained from the level of the mid signal, multiplied by the square of the distance from 1101 and 1112 (level correction taking account of the sound level, which decreases with the square of the distance). The propagation time difference L(β) in comparison with the mid signal for the simulated right-hand signal is 1111, and the level P(β) of the simulated signal is ascertained from the level of the mid signal, multiplied by the square of the distance from 1101 and 1113.

Trigonometrically, the following delay times L(α), L(β) and gain factors P(α), P(β) (which, in order to allow unrestricted selection of ϕ, α and β, can be applied to the signals S(α) and S(β) which produce the simulated side signal S, are accordingly obtained:

$$L_\alpha = -\frac{1}{2\sin\alpha} + \sqrt{\frac{1}{4\sin^2\alpha} + 1 - \frac{\sin\varphi}{\sin\alpha}} \tag{21}$$

$$L_\beta = -\frac{1}{2\sin\beta} + \sqrt{\frac{1}{4\sin^2\beta} + 1 + \frac{\sin\varphi}{\sin\beta}} \tag{22}$$

$$P_\alpha = \frac{1}{4\sin^2\alpha} + 1 - \frac{\sin\varphi}{\sin\alpha} \tag{23}$$

$$P_\beta = \frac{1}{4\sin^2\beta} + 1 + \frac{\sin\varphi}{\sin\beta} \tag{24}$$

Figure 12:
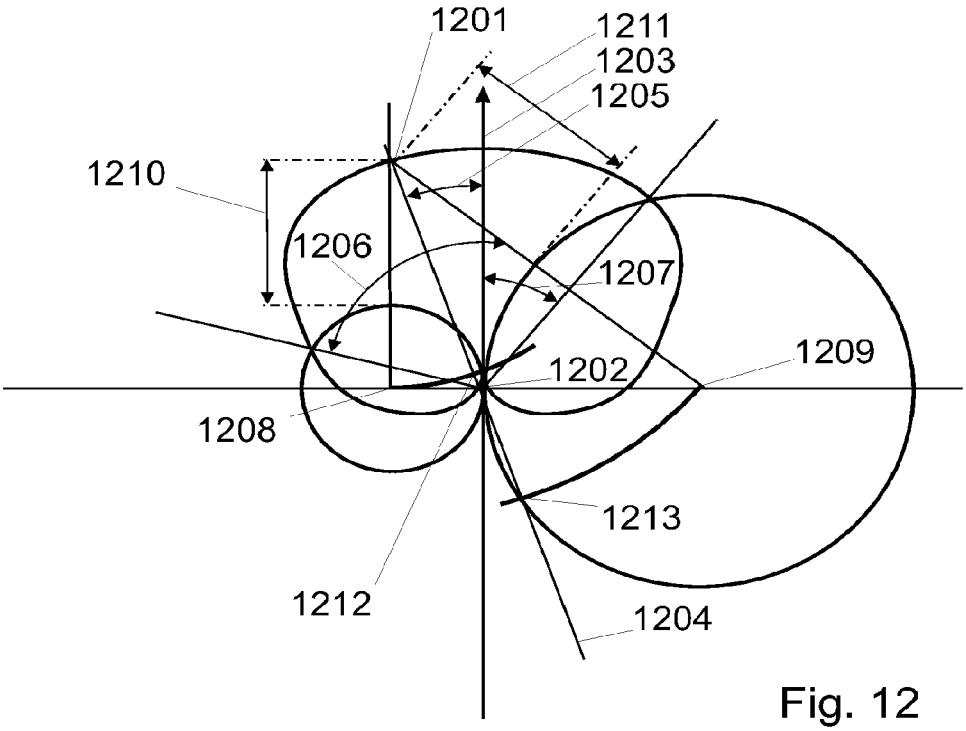
FIG. 12 shows an example of the operating principle of the invention for a signal having a cardioid pattern.

Application of the subject matter of the invention to a mid signal having a cardioid pattern (FIG. 12):

The arrangement under consideration in the present case comprises a sound source 1201, which is recorded by a mono microphone 1202 having a cardioid directivity pattern, wherein the microphone main axis 1203 and the directional axis 1204 of the sound source form the angle ϕ (1205). Subsequently, a fictitious left-hand opening angle α is parameterized (1206), and a fictitious right-hand opening angle β (1207), wherein again—if the sound source can be classified as being to the left of the main axis—the relationship ϕ≤α must apply or—if the sound source can be classified as being to the right of the main axis—the relationship $\phi \leq \beta$ must apply. Furthermore, in all cases, zero or a region around zero must again be ruled out for $\alpha$ and $\beta$ (since the levels and propagation time differences trigonometrically calculated by parameterizing $\alpha$ and $\beta$ likewise converge toward infinity, that is to say are technically infeasible).

$\alpha$, together with the present directivity pattern for the mid signal, determines exactly the geometric positioning 1208 of the simulated left-hand signal $S(\alpha)$, and $\beta$, likewise together with the directivity pattern under consideration here, determines exactly the geometric positioning 1209 of the simulated right-hand signal $S(\beta)$, which produce the simulated side signal when summed. The propagation time difference $L(\alpha)$ in comparison with the mid signal for the simulated left-hand signal is 1210, and the level $P(\alpha)$ of the simulated signal is ascertained from the level of the mid signal, multiplied by the square of the distance from 1201 and 1212 (level correction taking account of the sound level, which decreases with the square of the distance). The propagation time difference $L(\beta)$ in comparison with the mid signal for the simulated right-hand signal is 1211, and the level $P(\beta)$ of the simulated signal is ascertained from the level of the mid signal, multiplied by the square of the distance from 1201 and 1213.

Again, the following delay times $L(\alpha)$, $L(\beta)$ and gain factors $P(\alpha)$, $P(\beta)$ can be trigonometrically calculated taking account of the polar interval $$f(\psi) = \frac{1}{2}(1 + \cos\Psi)$$

which describes the cardioid directivity pattern of the M signal and which is dependent on the polar angle $\psi$ (wherein the gain factors—in order to allow unrestricted selection of $\phi$, $\alpha$ and $\beta$ in relation to the directivity pattern—can be applied to the signals $S(\alpha)$ and $S(\beta)$ which produce the simulated side signal S):

$$L_\alpha = -\frac{(1+\cos\alpha)}{4\sin\alpha} + \sqrt{\frac{(1+\cos\alpha)^2}{16\sin^2\alpha} + \frac{1}{4}(1+\cos\varphi)^2 - \frac{(1+\cos\alpha)}{4\sin\alpha} * (1+\cos\varphi) * \sin\varphi} \tag{25}$$

$$L_\beta = -\frac{(1+\cos\beta)}{4\sin\beta} + \sqrt{\frac{(1+\cos\beta)^2}{16\sin^2\beta} + \frac{1}{4}(1+\cos\varphi)^2 + \frac{(1+\cos\beta)}{4\sin\beta} * (1+\cos\varphi) * \sin\varphi} \tag{26}$$

$$P_\alpha = \frac{(1+\cos\alpha)^2}{16\sin^2\alpha} + \frac{1}{4}(1+\cos\varphi)^2 - \frac{(1+\cos\alpha)}{4\sin\alpha} * (1+\cos\varphi) * \sin\varphi \tag{27}$$

$$P_\beta = \frac{(1+\cos\beta)^2}{16\sin^2\beta} + \frac{1}{4}(1+\cos\varphi)^2 + \frac{(1+\cos\beta)}{4\sin\beta} * (1+\cos\varphi) * \sin\varphi \tag{28}$$

Figure 13:
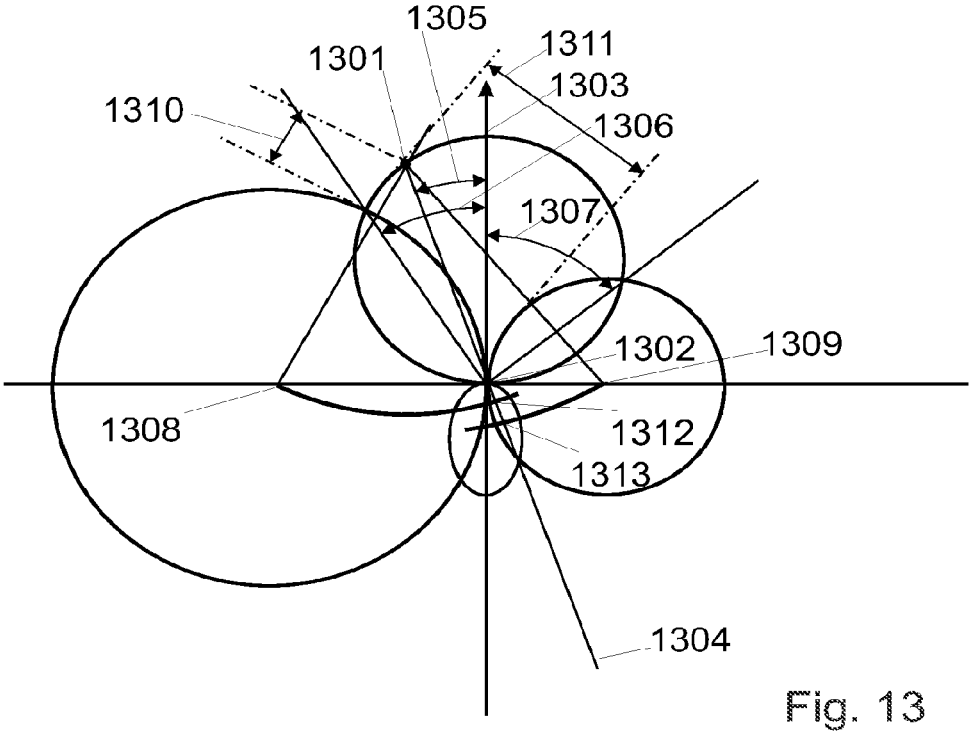
FIG. 13 shows an example of the operating principle of the invention for a signal having a hypercardioid pattern.

Application of the subject matter of the invention to a signal having a hypercardioid pattern (FIG. 13):

The arrangement comprises a sound source 1301 which is recorded by a mono microphone 1302 having a hypercardioid directivity pattern, wherein the microphone main axis 1303 and the directional axis 1304 of the sound source form the angle $\phi$ (1305). Subsequently, a fictitious left-hand opening angle $\alpha$ is again parameterized (1306) and also a fictitious right-hand opening angle $\beta$ (1307), wherein again—if the sound source can be classified as being to the left of the main axis—the relationship $\phi \leq \alpha$ must apply or—if the sound source can be classified as being to the right of the main axis—the relationship $\phi \leq \beta$ must apply. Again, in all cases, zero or a region around zero must be ruled out for $\alpha$ and $\beta$ (since the levels and propagation time differences trigonometrically calculated by parameterizing $\alpha$ and $\beta$ converge toward infinity, that is to say are technically infeasible).

$\alpha$, again together with the hypercardioid pattern of the mid signal, determines exactly the geometric positioning 1308 of the simulated right-hand signal $S(\alpha)$, $\beta$, together with the hypercardioid directivity pattern, determines exactly the geometric positioning 1309 of the simulated left-hand signal $S(\beta)$, which produce the simulated side signal when summed. The propagation time difference $L(\alpha)$ in comparison with the mid signal for the simulated left-hand signal is 1310, and the level $P(\alpha)$ of the simulated signal is ascertained from the level of the mid signal, multiplied by the square of the distance from 1301 and 1312 (level correction taking account of the sound level, which decreases with the square of the distance). The propagation time difference $L(\beta)$ in comparison with the mid signal for the simulated right-hand signal is 1311, and the level $P(\beta)$ of the simulated signal is ascertained from the level of the mid signal, multiplied by the square of the distance from 1301 and 1313.

The delay times $L(\alpha)$, $L(\beta)$ and gain factors $P(\alpha)$, $P(\beta)$ can be (taking account of the polar interval $$f(\psi) = 1 - \frac{n}{2} + \frac{n}{2} * \cos\psi, \tag{28a}$$

(where n assumes the value 1.5), which describes the hypercardioid directivity pattern of the M signal and which is dependent on the polar angle $\psi$) trigonometrically calculated (wherein the gain factors—in order to allow unrestricted selection of $\phi$, $\alpha$ and $\beta$ in relation to the directivity pattern—can be applied to the signals $S(\alpha)$ and $S(\beta)$, which produce the simulated side signal S):

$$L_\alpha = -\frac{\left(1 - \frac{n}{2} + \frac{n}{2} * \cos\alpha\right)}{2\sin\alpha} + \frac{\sqrt{\frac{\left(1 - \frac{n}{2} + \frac{n}{2} * \cos\alpha\right)^2}{4\sin^2\alpha} + \left(1 - \frac{n}{2} + \frac{n}{2} * \cos\varphi\right)^2}}{-\frac{\left(1 - \frac{n}{2} + \frac{n}{2} * \cos\alpha\right)}{\sin\alpha} * \left(1 - \frac{n}{2} + \frac{n}{2} * \cos\varphi\right) * \sin\varphi} \tag{29}$$

$$L_\beta = -\frac{\left(1 - \frac{n}{2} + \frac{n}{2} * \cos\beta\right)}{2\sin\beta} + \frac{\sqrt{\frac{\left(1 - \frac{n}{2} + \frac{n}{2} * \cos\beta\right)^2}{4\sin^2\beta} + \left(1 - \frac{n}{2} + \frac{n}{2} * \cos\varphi\right)^2}}{+\frac{\left(1 - \frac{n}{2} + \frac{n}{2} * \cos\beta\right)}{\sin\beta} * \left(1 - \frac{n}{2} + \frac{n}{2} * \cos\varphi\right) * \sin\varphi} \tag{30}$$

$$P_\alpha = \frac{\left(1 - \frac{n}{2} + \frac{n}{2} * \cos\alpha\right)^2}{4\sin^2\alpha} + \left(1 - \frac{n}{2} + \frac{n}{2} * \cos\varphi\right)^2 - \frac{\left(1 - \frac{n}{2} + \frac{n}{2} * \cos\alpha\right)}{\sin\alpha} * \left(1 - \frac{n}{2} + \frac{n}{2} * \cos\varphi\right) * \sin\varphi \tag{31}$$

-continued $$P_\beta = \frac{\left(1 - \frac{n}{2} + \frac{n}{2} * \cos\beta\right)^2}{4\sin^2\beta} + \left(1 - \frac{n}{2} + \frac{n}{2} * \cos\varphi\right)^2 + \frac{\left(1 - \frac{n}{2} + \frac{n}{2} * \cos\beta\right)}{\sin\beta} * \left(1 - \frac{n}{2} + \frac{n}{2} * \cos\varphi\right) * \sin\varphi \tag{32}$$

Application of the subject matter of the invention to signals having further special forms of a cardioid pattern:

If the input signal to be stereophonized has special forms of the cardioid pattern, the relevant propagation time differences L(α) and L(β) and gain factors P(α) and P(β) can easily be calculated from formulae (29) to (32). In this case, the following applies for n: $0 \le n \le 2$.

If n assumes the value 1, the gain factors and propagation time differences for an input signal having a classic cardioid directivity pattern are obtained, for the value 0 the gain factors and propagation time differences for an input signal having an omnidirectional directivity pattern are obtained, for the value 2 the gain factors and propagation time differences for an input signal having a classic figure-of-eight directivity pattern are obtained. If n assumes the value 1.25, the propagation time differences and gain factors for an input signal having a supercardioid pattern are obtained.

The application of formula (28a) to the polar interval f, resulting in the set of formulae (29) to (32), is accordingly found to be particularly favorable. Only the parameter n needs to be stipulated in order to describe almost all possible directivity patterns for the M signal, expressed in polar coordinates (apart from the shotgun pattern, which, as frequency rises, increasingly has polar coordinates other than it (28a) is able to represent).

Figure 14:
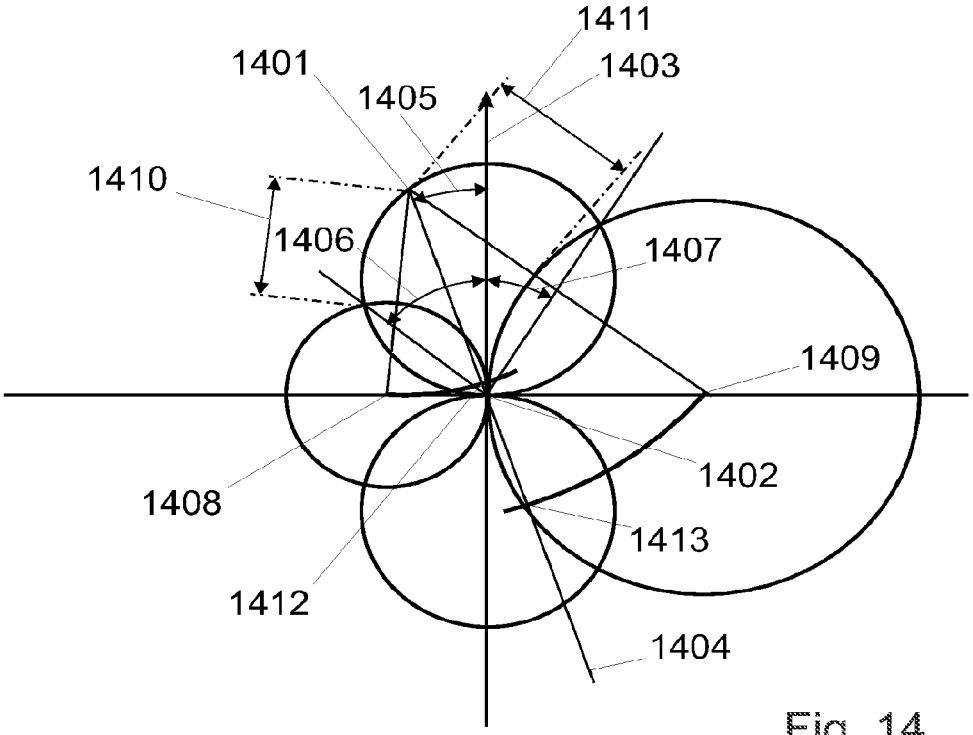
FIG. 14 shows an example of the operating principle of the invention for a signal having a figure-of-eight directivity pattern.

Application of the subject matter of the invention to a signal having a figure-of-eight pattern:

FIG. 14 again shows a detailed illustration of the instance of application for an input signal having a figure-of-eight directivity pattern, which has already been discussed more than once above. The arrangement comprises a sound source 1401 which is recorded by a mono microphone 1402 having a figure-of-eight directivity pattern, wherein the microphone main axis 1403 and the directional axis 1404 of the sound source form the angle φ (1405). A fictitious left-hand opening angle α is parameterized (1406) and also a fictitious right-hand opening angle β (1407), wherein again—if the sound source can be classified as being to the left of the main axis—the relationship $\phi \le \alpha$ must apply or—if the sound source can be classified as being to the right of the main axis—the relationship $\phi \le \beta$ must apply. Subsequently, in all cases, zero or a region around zero must likewise be ruled out for α and β (since the levels and propagation time differences trigonometrically calculated by parameterizing α and β likewise converge toward infinity, that is to say are technically infeasible).

α, together with the figure-of-eight directivity pattern of the mid signal, determines exactly the geometric positioning 1408 of the simulated left-hand signal S(α), and β, together with the figure-of-eight directivity pattern, determines exactly the geometric positioning 1409 of the simulated right-hand signal S(β), which produce the simulated side signal when summed. The propagation time difference L(α) in comparison with the mid signal for the simulated left-hand signal is 1410, and the level P(α) of the simulated signal is ascertained from the level of the mid signal, multiplied by the square of the distance from 1401 and 1412 (level correction taking account of the sound level, which decreases with the square of the distance). The propagation time difference L(β) in comparison with the mid signal for the simulated right-hand signal is 1411, and the level P(β) of the simulated signal is ascertained from the level of the mid signal, multiplied by the square of the distance from 1401 and 1413. The associated set of formulae for the delay times L(α), L(β) and the gain factors P(α), P(β) can be taken from equations (7) to (10), and from equations (29) to (32), if n is equal to 2 (where the gain factors—in order to allow unrestricted selection of φ, α and β in relation to the directivity pattern—can be applied to the signals S(α) and S(β) which produce the simulated side signal S).

Application of the subject matter of the invention to a circuit for stereophonizing a mono signal:

FIG. 15 shows a circuit based on the subject matter of the invention which generalizes the directivity pattern of the input signal and which takes account of the recording angle φ, of a left-hand fictitious opening angle α, of a right-hand fictitious opening angle β and of an angle-dependent polar interval f describing the directivity pattern of the M signal in order to convert a monophonic audio signal into MS signals which can be stereophonized. In this case, formulae (3) to (6) can be used for the propagation time differences L(α) and L(β) and the gain factors P(α) and P(β). The input signal is used directly as the M signal in this case. The S signal is added up from the input signal delayed by the delay time L(α), which subsequently is amplified by the gain factor P(α), and a further signal which represents the input signal delayed by the delay time L(β), subsequently amplified by the gain factor P(β). Again, the relationship $\phi \le \alpha$ must apply—if $\phi > 0$—or the relationship $|\phi| \le \beta$ must apply—if $\phi < 0$. Similarly, in all cases, zero or a region around zero must be ruled out for α and β (since the levels and propagation time differences trigonometrically calculated by parameterizing α and β converge toward infinity, that is to say are technically infeasible).

Figure 16:
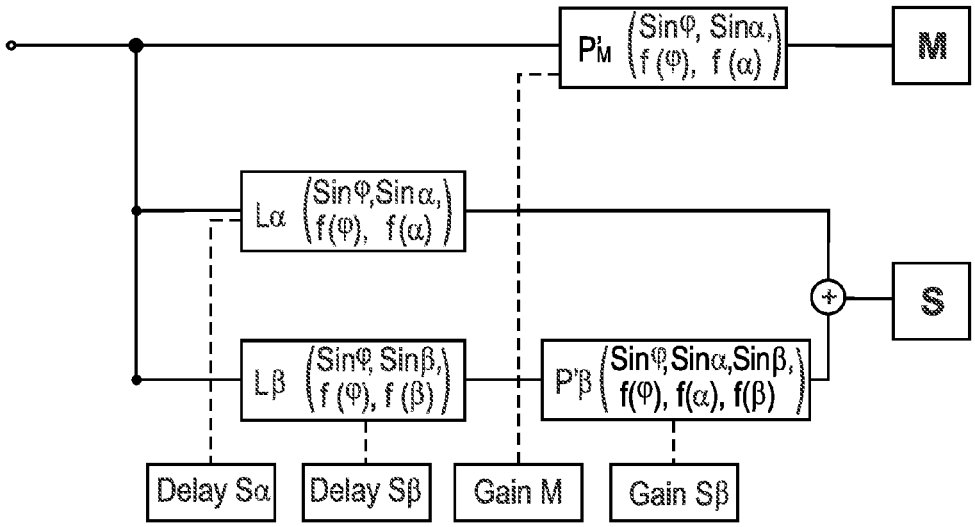
FIG. 16 shows a variant for the circuit in FIG. 15, wherein for the recording angle ϕ, the left-hand fictitious opening angle α and the angle-dependent polar interval f describing the directivity pattern of the M signal it must be true that the expression $$\frac{f^2(\alpha)}{4\sin^2\alpha} + f^2(\varphi) - \frac{f(\alpha)}{\sin\alpha} * f(\varphi) * \sin\varphi \tag{11}$$

Derivations of circuits which deliver equivalent signals under slight restrictions:

FIG. 15 can be used to infer a slightly restrictedly operating circuit of the form in FIG. 16 when the gain factors are reweighted. In this case, the restriction is the condition that for the recording angle φ, the left-hand fictitious opening angle α and the angle-dependent polar interval f describing the directivity pattern of the M signal it must be true that the expression $$\frac{f^2(\alpha)}{4\sin^2\alpha} + f^2(\varphi) - \frac{f(\alpha)}{\sin\alpha} * f(\varphi) * \sin\varphi \tag{33}$$

is not equal to zero or an element of a region around zero. The propagation time differences L(α) and L(β) cited in FIG. 16 directly represent equations (3) and (4) in this case; for the gain factors $P_M$, and P(β)', the relationships $$P'_M = \frac{1}{\frac{f^2(\alpha)}{4\sin^2\alpha} + f^2(\varphi) - \frac{f(\alpha)}{\sin\alpha} * f(\varphi) * \sin\varphi} \tag{34}$$

$$P'_\beta = \frac{\frac{f^2(\beta)}{4\sin^2\beta} + f^2(\varphi) + \frac{f(\beta)}{\sin\beta} * f(\varphi) * \sin\varphi}{\frac{f^2(\alpha)}{4\sin^2\alpha} + f^2(\varphi) - \frac{f(\alpha)}{\sin\alpha} * f(\varphi) * \sin\varphi} \tag{35}$$

apply.

In addition, the relationship $\phi \leq \alpha$ must apply—if $\phi > 0$—or the relationship $|\phi| \leq \beta$ must apply—if $\phi < 0$. Again, in all cases, zero or a region around zero must be ruled out for $\alpha$ and $\beta$ (since the levels and propagation time differences trigonometrically calculated by parameterizing $\alpha$ and $\beta$ converge to some extent toward infinity, that is to say are technically infeasible).

A second derivation from FIG. 15 given a change in the reweighting of the gain factors produces a likewise slightly restrictedly operating circuit in the form from FIG. 17, wherein it must be true for the recording angle $\phi$, the right-hand fictitious opening angle $\beta$ and the angle-dependent polar interval f describing the directivity pattern of the M signal that the expression $$\frac{f^2(\beta)}{4\sin^2\beta} + f^2(\varphi) + \frac{f(\beta)}{\sin\beta} * f(\varphi) * \sin\varphi \tag{36}$$

is not equal to zero or an element of a region around zero. The propagation time differences $L(\alpha)$ and $L(\beta)$ cited in FIG. 17 are again equations (3) and (4) in this case; for the gain factors $P_{M''}$ and $P(\alpha)'$, however, the relationships $$P''_M = \frac{1}{\frac{f^2(\beta)}{4\sin^2\beta} + f^2(\varphi) + \frac{f(\beta)}{\sin\beta} * f(\varphi) * \sin\varphi} \tag{37}$$

$$P'_\alpha = \frac{\frac{f^2(\alpha)}{4\sin^2\alpha} + f^2(\varphi) - \frac{f(\alpha)}{\sin\alpha} * f(\varphi) * \sin\varphi}{\frac{f^2(\beta)}{4\sin^2\beta} + f^2(\varphi) + \frac{f(\beta)}{\sin\beta} * f(\varphi) * \sin\varphi} \tag{38}$$

now apply.

Again, the relationship $\phi \leq \alpha$ must apply—if $\phi > 0$—or the relationship $|\phi| \leq \beta$ must apply—if $\phi < 0$. Similarly, in all cases, zero or a region around zero must be ruled out for $\alpha$ and $\beta$ (since the levels and propagation time differences trigonometrically calculated by parameterizing $\alpha$ and $\beta$ converge to some extent toward infinity, that is to say are technically infeasible).

Application of the subject matter of the invention to a computation method for stereophonizing a mono signal:

A monophonic input signal can be arithmetically represented using a coordinate system in the form in FIG. 18, where 1814 is the time axis and 1815 is the level axis. 1819 is the time $t_i$, and 1820 is the level point $P_i(t_i)$ correlated to $t_i$. For sufficiently small intervals $[t_i, t_{i+1}]$, that is to say a sufficient sampling rate, it is now possible to depict the sound event with sufficient accuracy.

FIG. 19 shows the associated flowchart for a method based on the subject matter of the invention which takes account of the recording angle $\phi$, of a left-hand fictitious opening angle $\alpha$, of a right-hand fictitious opening angle $\beta$ and of an angle-dependent polar interval f describing the directivity pattern of the M signal, given sufficiently small intervals $[t_i, t_{i+1}]$, in order to convert a monophonic audio signal into MS signals which can be stereophonized (under the simplifying assumption that the propagation time difference $L(\alpha)$ or the propagation time difference $L(\beta)$ remains unequal to zero).

For the propagation time differences $L(\alpha)$ and $L(\beta)$ and the gain factors $P(\alpha)$ and $P(\beta)$, equations (3) to (6) again subsequently apply.

An M signal (the array $[M_i(t_i)]$) and an S signal (the array $[S_i(t_i)]$), which is actually added up from the input signal delayed by the delay time $L(\alpha)$, which is amplified by the gain factor $P(\alpha)$, and a further signal, which is the input signal actually delayed by the delay time $L(\beta)$, subsequently amplified by the gain factor $P(\beta)$. The algorithm rules out inadmissible values of $\alpha$ and $\beta$. In general, the relationship $\phi \leq \alpha$ must apply for such algorithms—if $\phi > 0$—or the relationship $|\phi| \leq \beta$ must apply—if $\phi < 0$. Similarly, in all cases, zero or a region around zero must be ruled out for $\alpha$ and $\beta$ (since the levels and propagation time differences trigonometrically calculated by parameterizing $\alpha$ and $\beta$ converge toward infinity, that is to say are technically infeasible).

Derivations of two computation methods which deliver equivalent signals under slight restrictions:

Method 1: If it remains algorithmically assured that (33) is not equal to zero or an element of a region around zero, a computation method similar to FIG. 19 can be applied to a monophonic input signal for sufficiently small intervals $[t_i, t_{i+1}]$ in a manner shown in FIG. 16, but with the M signal (the array $[M_i(t_i)]$) now appearing amplified by the factor (34). The S signal (the array $[S_i(t_i)]$) is the result of the addition of the input signal (the array $[P_i(t_i)]$) actually delayed by the delay time $L(\alpha)$ (see formula (3)) to the input signal (again the array $[P_i(t_i)]$) actually delayed by the delay time $L(\beta)$ (see formula (4)) and then amplified by the factor $P(\beta)'$ (see formula (35)). The algorithm must rule out inadmissible values of $\alpha$ and $\beta$: the relationship $\phi \leq \alpha$ must apply—if $\phi > 0$—or the relationship $|\phi| \leq \beta$ must apply—if $\phi < 0$. Similarly, in all cases, zero or a region around zero must be ruled out for $\alpha$ and $\beta$ (since the levels and propagation time differences trigonometrically calculated by parameterizing $\alpha$ and $\beta$ converge to some extent toward infinity, that is to say remain technically infeasible).

Method 2: If it remains algorithmically assured that (36) is not equal to zero or an element of a region around zero, a computation method similar to FIG. 19 can likewise be applied to a monophonic input signal for sufficiently small intervals $[t_i, t_{i+1}]$ in the manner of FIG. 17, with the M signal (the array $[M_i(t_i)]$) now appearing amplified by the factor (37). The S signal (the array $[S_i(t_i)]$) is the result of the addition of the input signal (the array $[P_i(t_i)]$) actually delayed by the delay time $L(\alpha)$ (see formula (3)) and subsequently amplified by the gain factor $P(\alpha)'$ (see formula (38)) to the input signal (again the array $[P_i(t_i)]$) actually delayed by the delay time $L(\beta)$ (see formula (4)). The algorithm must rule out inadmissible values of $\alpha$ and $\beta$. The relationship $\phi \leq \alpha$ must apply—if $\phi > 0$—or the relationship $|\phi| \leq \beta$ must apply—if $\phi < 0$. Similarly, in all cases, zero or a region around zero must be ruled out for $\alpha$ and $\beta$ (since the levels and propagation time differences trigonometrically calculated by parameterizing $\alpha$ and $\beta$ converge to some extent toward infinity, that is to say remain technically infeasible).

Observed overall, the apparatuses and methods described naturally also permit the amplification of the respective input signal before a subsequent delay is executed.

Examples of Areas of Application for the Invention

The spatial breakdown of a sound source recorded at a particular angle $\phi$ has great practical significance particularly for telephone signals. In the case of hands-free devices, such as are used in automobiles or for internet telephony, the monophonic signal emitted is perceived as not corresponding to the real interlocutory situation; the opposite appears "omnipresent". If, however, metrological methods associated with the prior art are used to ascertain the angle $\phi$ or to functionally interpolate the polar coordinates (possible by virtue of algorithmic consideration of the maxima and minima in the polar diagram of the input signal), and if the fictitious left-hand opening angle $\alpha$ and the fictitious right-hand opening angle $\beta$ are subsequently matched algorithmically or manually to the recording and listening situation, it is possible to use a (miniaturizable!) circuit in the form in FIG. 15, for example, to attain a stereophonic signal, during final MS matrixing, which takes much greater account of a interlocutory situation under natural conditions.

The procedure may be similar with monophonic sound recordings in which sound sources need to be reproduced stereophonically.

Similarly, if the direction of depiction of a sound source—insulated by means of signal processing—within a stereo image is perceived as being too acute, the direction of depiction can be gradually dispersed by applying the subject matter of the invention.

The shaping of the directivity pattern of the input signal (possible point by point by varying the polar coordinates which describe the directivity pattern of the input signal, comprehensively possible, by way of example, by means of the application—associated with the prior art—of comb filters in conjunction with methods based on fast Fourier transformation (FFT)) before it passes through an arrangement or a method in accordance with the subject matter of the invention can sometimes improve the result further or ensure that the directivity pattern of the input signal is normalized.

The invention can achieve an overall significant contribution to the retrospective multidimensional consideration of signal paths. The application thereof is therefore not limited to the examples above.

The invention claimed is:

1. An apparatus for stereophonizing a mono signal, wherein said apparatus is configured to provide:

(a) evaluation of manually or metrologically ascertained angle $\phi$ between sound source and microphone main axis in combination with (aa) an arbitrarily or algorithmically determined fictitious opening angle $\alpha$, which adjoins the microphone main axis on the left, is not an element of a region around zero or equal to zero, and for which, if the angle $\phi$ is positive, a condition is satisfied that the angle $\phi$ is less than or equal to the angle $\alpha$;

(bb) an arbitrarily or algorithmically determined fictitious opening angle $\beta$, which adjoins the microphone main axis on the right, is not an element of a region around zero or equal to zero, and for which, if the angle $\phi$ is negative, a condition is satisfied that the absolute value of the angle $\phi$ is less than or equal to the angle $\beta$;

(cc) manually or metrologically determined directivity pattern of the mono signal to be stereophonized, representable in polar coordinates;

the apparatus comprising:

(b) a first circuit element for calculating a gain factor $P(\alpha)$, which is dependent on the angle $\phi$, on the angle $\alpha$ and on the directivity pattern of the mono signal to be stereophonized;

(c) a second circuit element for calculating a gain factor $P(\beta)$, which is dependent on the angle $\phi$, on the angle $\beta$ and on the directivity pattern of the mono signal to be stereophonized;

(d) a third circuit element for calculating a delay time $L(\alpha)$, which is dependent on the angle $\phi$, on the angle $\alpha$ and on the directivity pattern of the mono signal to be stereophonized;

(e) a fourth circuit element for calculating a delay time $L(\beta)$, which is dependent on the angle $\phi$, on the angle $\beta$ and on the directivity pattern of the mono signal to be stereophonized;

wherein the apparatus is configured for:

(f) direct use of the mono signal to be stereophonized as a mid signal;

(g) delay of the mono signal to be stereophonized by the delay time $L(\alpha)$ and amplification of the delayed signal by the gain factor $P(\alpha)$; or alternatively: amplification of the mono signal to be stereophonized by the gain factor $P(\alpha)$ and delay of the amplified signal by the delay time $L(\alpha)$;

(h) delay of the mono signal to be stereophonized by the delay time $L(\beta)$ and amplification of the delayed signal by the gain factor $P(\beta)$; or alternatively: amplification of the mono signal to be stereophonized by the gain factor $P(\beta)$ and delay of the amplified signal by the delay time $L(\beta)$;

(i) addition of the signals obtained under (g) and (h) in order to obtain a side signal; and (j) stereo decoding of the mid and the side signal into a stereo signal.

2. The apparatus for stereophonizing a mono signal as claimed in claim 1, wherein:

(a) the gain factor $P(\alpha)$ is equal to the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$;

(b) the gain factor $P(\beta)$ is equal to the squared polar interval for the angle $\beta$, divided by the squared sine of $\beta$ multiplied by 4, plus the squared polar interval for the angle $\phi$, plus the product of the polar interval for the angle $\beta$, the polar interval for the angle $\phi$ and the sine of $\phi$ divided by the sine of $\beta$;

(c) the delay time $L(\alpha)$ is equal to the negative polar interval for the angle $\alpha$, divided by the doubled sine of $\alpha$, plus the square root of the gain factor $P(\alpha)$ described in (a);

(d) the delay time $L(\beta)$ is equal to the negative polar interval for the angle $\beta$, divided by the doubled sine of $\beta$, plus the square root of the gain factor $P(\beta)$ described in (b).

3. The apparatus as claimed in claim 2, including an additional transformation of the respectively obtained stereo signal into stereophonic signals which are reproduced by more than two loudspeakers.

4. An apparatus for obtaining an equivalent stereo signal for the stereo signal obtained in accordance with claim 1 from a mono signal, wherein said apparatus is further configured to provide:

(a) evaluation of the manually or metrologically ascertained angle $\phi$ between sound source and microphone main axis in combination with (aa) an arbitrarily or algorithmically determined fictitious opening angle $\alpha$, which adjoins the microphone main axis on the left, is not an element of a region around zero or equal to zero, and for which, if the angle $\phi$ is positive, a condition is satisfied that the angle $\phi$ is less than or equal to the angle $\alpha$;

(bb) an arbitrarily or algorithmically determined fictitious opening angle $\beta$, which adjoins the microphone main axis on the right, is not an element of a region around zero or equal to zero, and for which, if the angle $\phi$ is negative, a condition is satisfied that the absolute value of the angle $\phi$ is less than or equal to the angle $\beta$;

(cc) manually or metrologically determined directivity pattern of the mono signal to be stereophonized, representable in polar coordinates;

(dd) satisfaction of a condition that the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$ is not an element of a region around zero or equal to zero;

wherein the apparatus is further configured to provide:

(b) calculation of a gain factor $P_M'$, which is dependent on the angle $\phi$, on the angle $\alpha$ and on the directivity pattern of the mono signal to be stereophonized;

(c) calculation of a gain factor $P(\beta)'$, which is dependent on the angle $\phi$, on the angle $\alpha$, on the angle $\beta$ and on the directivity pattern of the mono signal to be stereophonized;

(d) calculation of a delay time $L(\alpha)$, which is dependent on the angle $\phi$, on the angle $\alpha$ and on the directivity pattern of the mono signal to be stereophonized;

(e) calculation of a delay time $L(\beta)$, which is dependent on the angle $\phi$, on the angle $\beta$ and on the directivity pattern of the mono signal to be stereophonized;

(f) amplification of the mono signal to be stereophonized by the gain factor $P_M'$ in order to obtain the mid signal;

(g) delay of the mono signal to be stereophonized by the delay time $L(\alpha)$;

(h) delay of the mono signal to be stereophonized by the delay time $L(\beta)$ and amplification of the delayed signal by the gain factor $P(\beta)'$; or alternatively: the amplification of the mono signal to be stereophonized by the gain factor $P(\beta)'$ and the delay of the amplified signal by the delay time $L(\beta)$;

(i) addition of the signals obtained under (g) and (h) in order to obtain a side signal; and (j) stereo decoding of the mid and the side signals into a stereo signal.

5. The apparatus f as claimed in claim 4, wherein:

(a) the gain factor $P_M'$ is equal to the reciprocal value of the result which is calculated from the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$;

(b) the gain factor $P(\beta)'$ is equal to the product of the gain factor $P_M'$ described in (a) and the gain factor $P(\beta)$ described in claim 2(b);

(c) the delay time $L(\alpha)$ is equal to the negative polar interval for the angle $\alpha$, divided by the doubled sine of $\alpha$, plus the square root of the result which is calculated from the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$;

(d) the delay time $L(\beta)$ is equal to the negative polar interval for the angle $\beta$, divided by the doubled sine of $\beta$, plus the square root of the result which is calculated from the squared polar interval for the angle $\beta$, divided by the squared sine of $\beta$ multiplied by 4, plus the squared polar interval for the angle $\phi$, plus the product of the polar interval for the angle $\beta$, the polar interval for the angle $\phi$ and the sine of $\phi$ divided by the sine of $\beta$.

6. The apparatus as claimed in claim 5, including an additional transformation of the respectively obtained stereo signal into stereophonic signals which are reproduced by more than two loudspeakers.

7. The apparatus as claimed in claim 4, including an additional transformation of the respectively obtained stereo signal into stereophonic signals which are reproduced by more than two loudspeakers.

8. An apparatus for obtaining an equivalent stereo signal for the stereo signal obtained in accordance with claim 1 from a mono signal, wherein said apparatus is further configured to provide:

(a) evaluation of the manually or metrologically ascertained angle $\phi$ between sound source and the microphone main axis in combination with (aa) an arbitrarily or algorithmically determined fictitious opening angle $\alpha$, which adjoins the microphone main axis on the left, is not an element of a region around zero or equal to zero, and for which, if the angle $\phi$ is positive, a condition is satisfied that the angle $\phi$ is less than or equal to the angle $\alpha$;

(bb) an arbitrarily or algorithmically determined fictitious opening angle $\beta$, which adjoins the microphone main axis on the right, is not an element of a region around zero or equal to zero, and for which, if the angle $\phi$ is negative, a condition is satisfied that the absolute value of the angle $\phi$ is less than or equal to the angle $\beta$;

(cc) manually or metrologically determined directivity pattern of the mono signal to be stereophonized, representable in polar coordinates;

(dd) satisfaction of a condition that the squared polar interval for the angle $\beta$, divided by the squared sine of $\beta$ multiplied by 4, plus the squared polar interval for the angle $\phi$, plus the product of the polar interval for the angle $\beta$, the polar interval for the angle $\phi$ and the sine of $\phi$ divided by the sine of $\beta$ is not an element of a region around zero or equal to zero;

wherein the apparatus is further configured to provide:

(b) calculation of a gain factor $P_M''$, which is dependent on the angle $\phi$, on the angle $\beta$ and on the directivity pattern of the mono signal to be stereophonized;

(c) calculation of a gain factor $P(\alpha)'$, which is dependent on the angle $\phi$, on the angle $\alpha$, on the angle $\beta$ and on the directivity pattern of the mono signal to be stereophonized;

(d) calculation of a delay time $L(\alpha)$, which is dependent on the angle $\phi$, on the angle $\alpha$ and on the directivity pattern of the mono signal to be stereophonized;

(e) the calculation of a delay time $L(\beta)$, which is dependent on the angle $\phi$, on the angle $\beta$ and on the directivity pattern of the mono signal to be stereophonized;

(f) amplification of the mono signal to be stereophonized by the gain factor $P_M''$ in order to obtain the mid signal;

(g) delay of the mono signal to be stereophonized by the delay time $L(\alpha)$ and amplification of the delayed signal by the gain factor $P(\alpha)'$; or alternatively: amplification of the mono signal to be stereophonized by the gain factor $P(\alpha)'$ and delay of the amplified signal by the delay time $L(\alpha)$;

(h) delay of the mono signal to be stereophonized by the delay time $L(\beta)$;

(i) addition of the signals obtained under (g) and (h) in order to obtain a side signal; and (j) stereo decoding of the mid and the side signal into a stereo signal.

9. The apparatus as claimed in claim 8, wherein:

(a) the gain factor $P_M''$ is equal to the reciprocal value of the result which is calculated from the squared polar interval for the angle β, divided by the squared sine of β multiplied by 4, plus the squared polar interval for the angle ϕ, plus the product of the polar interval for the angle β, the polar interval for the angle ϕ and the sine of ϕ divided by the sine of β;

(b) the gain factor P(α)' is equal to the product of the gain factor $P_M''$ described in (a) and the gain factor P(α) described in claim 2(a);

(c) the delay time L(α) is equal to the negative polar interval for the angle α, divided by the doubled sine of α, plus the square root of the result which is calculated from the squared polar interval for the angle α, divided by the squared sine of α multiplied by 4, plus the squared polar interval for the angle ϕ, minus the product of the polar interval for the angle α, the polar interval for the angle ϕ and the sine of ϕ divided by the sine of α;

(d) the delay time L(β) is equal to the negative polar interval for the angle β, divided by the doubled sine of β, plus the square root of the result which is calculated from the squared polar interval for the angle β, divided by the squared sine of β multiplied by 4, plus the squared polar interval for the angle ϕ, plus the product of the polar interval for the angle β, the polar interval for the angle ϕ and the sine of ϕ divided by the sine of β.

10. The apparatus as claimed in claim 9, including an additional transformation of the respectively obtained stereo signal into stereophonic signals which are reproduced by more than two loudspeakers.

11. The apparatus as claimed in claim 8, including an additional transformation of the respectively obtained stereo signal into stereophonic signals which are reproduced by more than two loudspeakers.

12. The apparatus as claimed in claim 1, including an additional transformation of the respectively obtained stereo signal into stereophonic signals which are reproduced by more than two loudspeakers.

13. A method for stereophonizing a mono signal using an apparatus comprising a circuit, said method comprising:

(a) evaluation of the manually or metrologically ascertained angle ϕ between sound source and microphone main axis in combination with (aa) an arbitrarily or algorithmically determined fictitious opening angle α, which adjoins the microphone main axis on the left, is not an element of a region around zero or equal to zero, and for which, if the angle ϕ is positive, a condition is satisfied that the angle ϕ is less than or equal to the angle α;

(bb) an arbitrarily or algorithmically determined fictitious opening angle β, which adjoins the microphone main axis on the right, is not an element of a region around zero or equal to zero, and for which, if the angle ϕ is negative, a condition is satisfied that the absolute value of the angle ϕ is less than or equal to the angle β;

(cc) manually or metrologically determining a directivity pattern of the mono signal to be stereophonized, representable in polar coordinates;

(b) using the circuit for calculating a gain factor P(α), which is dependent on the angle ϕ, on the angle α and on the directivity pattern of the mono signal to be stereophonized;

(c) using the circuit for calculating a gain factor P(β), which is dependent on the angle ϕ, on the angle β and on the directivity pattern of the mono signal to be stereophonized;

(d) using the circuit for calculating a delay time L(α), which is dependent on the angle ϕ, on the angle α and on the directivity pattern of the mono signal to be stereophonized;

(e) using the circuit for calculating a delay time L(β), which is dependent on the angle ϕ, on the angle β and on the directivity pattern of the mono signal to be stereophonized;

(f) direct use of the mono signal to be stereophonized as a mid signal;

(g) using the circuit to obtain a delay of the mono signal to be stereophonized by the delay time L(α) and an amplification of the delayed signal by the gain factor P(α); or alternatively: using the circuit to obtain an amplification of the mono signal to be stereophonized by the gain factor P(α) and a delay of the amplified signal by the delay time L(α);

(h) using the circuit to obtain a delay of the mono signal to be stereophonized by the delay time L(β) and an amplification of the delayed signal by the gain factor P(β); or alternatively: using the circuit to obtain an amplification of the mono signal to be stereophonized by the gain factor P(β) and a delay of the amplified signal by the delay time L(β);

(i) using the circuit for adding the signals obtained under (g) and (h) in order to obtain a side signal;

(j) providing stereo decoding of the mid and the side signal into a stereo signal.

14. The method as claimed in claim 13, wherein:

(a) the circuit provides a gain factor P(α) equal to the squared polar interval for the angle α, divided by the squared sine of α multiplied by 4, plus the squared polar interval for the angle ϕ, minus the product of the polar interval for the angle α, the polar interval for the angle ϕ and the sine of ϕ divided by the sine of α;

(b) the circuit provides a gain factor P(β) equal to the squared polar interval for the angle β, divided by the squared sine of β multiplied by 4, plus the squared polar interval for the angle ϕ, plus the product of the polar interval for the angle β, the polar interval for the angle ϕ and the sine of ϕ divided by the sine of β;

(c) the circuit provides a delay time L(α) equal to the negative polar interval for the angle α, divided by the doubled sine of α, plus the square root of the gain factor P(α) described in (a);

(d) the circuit provides a delay time L(β) equal to the negative polar interval for the angle β, divided by the doubled sine of β, plus the square root of the gain factor P(β) described in (b).

15. The method as claimed in claim 14, including an additional transformation of the respectively obtained stereo signal into stereophonic signals which are reproduced by more than two loudspeakers.

16. A method for obtaining an equivalent stereo signal for the stereo signal obtained in accordance with claim 13 from a mono signal, wherein:

(a) evaluating a manually or metrologically ascertained angle ϕ between sound source and the microphone main axis in combination with (aa) an arbitrarily or algorithmically determined fictitious opening angle α, which adjoins the microphone main axis on the left, is not an element of a region around zero or equal to zero, and for which, if the angle ϕ is positive, a condition is satisfied that the angle ϕ is less than or equal to the angle α;

(bb) an arbitrarily or algorithmically determined fictitious opening angle β, which adjoins the microphone main axis on the right, is not an element of a region around zero or equal to zero, and for which, if the angle $\phi$ is negative, a condition is satisfied that the absolute value of the angle $\phi$ is less than or equal to the angle $\beta$;

(cc) manually or metrologically determined directivity pattern of the mono signal to be stereophonized, representable in polar coordinates;

(dd) satisfaction of a condition that the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$ is not an element of a region around zero or equal to zero;

(b) the circuit calculating a gain factor $P_M$, which is dependent on the angle $\phi$, on the angle $\alpha$ and on the directivity pattern of the mono signal to be stereophonized;

(c) the circuit calculating a gain factor $P(\beta)'$, which is dependent on the angle $\phi$, on the angle $\alpha$, on the angle $\beta$ and on the directivity pattern of the mono signal to be stereophonized;

(d) the circuit calculating a delay time $L(\alpha)$, which is dependent on the angle $\phi$, on the angle $\alpha$ and on the directivity pattern of the mono signal to be stereophonized;

(e) the circuit calculating a delay time $L(\beta)$, which is dependent on the angle $\phi$, on the angle $\beta$ and on the directivity pattern of the mono signal to be stereophonized;

(f) the circuit amplifying the mono signal to be stereophonized by the gain factor $P_M'$ in order to obtain the mid signal;

(g) the circuit providing a delay of the mono signal to be stereophonized by the delay time $L(\alpha)$;

(h) the circuit providing a delay of the mono signal to be stereophonized by the delay time $L(\beta)$ and amplification of the delayed signal by the gain factor $P(\beta)'$; or alternatively: the circuit providing an amplification of the mono signal to be stereophonized by the gain factor $P(\beta)'$ and a delay of the amplified signal by the delay time $L(\beta)$;

(i) the circuit adding the signals obtained under (g) and (h) in order to obtain a side signal;

(j) stereo decoding of the mid and the side signal into a stereo signal.

17. The method as claimed in claim 16, wherein:

(a) the circuit provides a gain factor $P_M'$ equal to the reciprocal value of the result which is calculated from the squared polar interval for the angle $\alpha$, divided by the square sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$;

(b) the circuit provides a gain factor $P(\beta)'$ equal to the product of the gain factor $P_M'$ described in (a) and the gain factor $P(\beta)$ described in claim 2(b);

(c) the circuit provides a delay time $L(\alpha)$ equal to the negative polar interval for the angle $\alpha$, divided by the doubled sine of $\alpha$, plus the square root of the result which is calculated from the squared polar interval for the angle $\alpha$, divided by the squared sine of $\alpha$ multiplied by 4, plus the squared polar interval for the angle $\phi$, minus the product of the polar interval for the angle $\alpha$, the polar interval for the angle $\phi$ and the sine of $\phi$ divided by the sine of $\alpha$;

(d) the circuit provides a delay time $L(\beta)$ equal to the negative polar interval for the angle $\beta$, divided by the doubled sine of $\beta$, plus the square root of the result which is calculated from the squared polar interval for the angle $\beta$, divided by the squared sine of $\beta$ multiplied by 4, plus the squared polar interval for the angle $\phi$, plus the product of the polar interval for the angle $\beta$, the polar interval for the angle $\phi$ and the sine of $\phi$ divided by the sine of $\beta$.

18. The method as claimed in claim 17, including an additional transformation of the respectively obtained stereo signal into stereophonic signals which are reproduced by more than two loudspeakers.

19. The method as claimed in claim 16, including an additional transformation of the respectively obtained stereo signal into stereophonic signals which are reproduced by more than two loudspeakers.

20. A method for obtaining an equivalent stereo signal for the stereo signal obtained in accordance with claim 13 from a mono signal, wherein:

(a) evaluating a manually or metrologically ascertained angle $\phi$ between sound source and the microphone main axis in combination with (aa) an arbitrarily or algorithmically determined fictitious opening angle $\alpha$, which adjoins the microphone main axis on the left, is not an element of a region around zero or equal to zero, and for which, if the angle $\phi$ is positive, a condition is satisfied that the angle $\phi$ is less than or equal to the angle $\alpha$;

(bb) an arbitrarily or algorithmically determined fictitious opening angle $\beta$, which adjoins the microphone main axis on the right, is not an element of a region around zero or equal to zero, and for which, if the angle $\phi$ is negative, a condition is satisfied that the absolute value of the angle $\phi$ is less than or equal to the angle $\beta$;

(cc) manually or metrologically determined directivity pattern of the mono signal to be stereophonized, representable in polar coordinates;

(dd) satisfaction of a condition that the squared polar interval for the angle $\beta$, divided by the squared sine of $\beta$ multiplied by 4, plus the squared polar interval for the angle $\phi$, plus the product of the polar interval for the angle $\beta$, the polar interval for the angle $\phi$ and the sine of $\phi$ divided by the sine of $\beta$ is not an element of a region around zero or equal to zero;

(b) the circuit calculating a gain factor $P_M''$, which is dependent on the angle $\phi$, on the angle $\beta$ and on the directivity pattern of the mono signal to be stereophonized;

(c) the circuit calculating a gain factor $P(\alpha)'$, which is dependent on the angle $\phi$, on the angle $\alpha$, on the angle $\beta$ and on the directivity pattern of the mono signal to be stereophonized;

(d) the circuit calculating a delay time $L(\alpha)$, which is dependent on the angle $\phi$, on the angle $\alpha$ and on the directivity pattern of the mono signal to be stereophonized;

(e) the circuit calculates a delay time $L(\beta)$, which is dependent on the angle $\phi$, on the angle $\beta$ and on the directivity pattern of the mono signal to be stereophonized;

(f) the circuit amplifying the mono signal to be stereophonized by the gain factor $P_M''$ in order to obtain the mid signal;

(g) the circuit providing a delay of the mono signal to be stereophonized by the delay time $L(\alpha)$ and amplification of the delayed signal by the gain factor $P(\alpha)'$; or alternatively: the circuit providing amplification of the mono signal to be stereophonized by the gain factor $P(\alpha)'$ and a delay of the amplified signal by the delay time $L(\alpha)$;

(h) the circuit providing a delay of the mono signal to be stereophonized by the delay time $L(\beta)$;

(i) the circuit adding the signals obtained under (g) and (h) in order to obtain a side signal;

(j) stereo decoding of the mid and the side signals into a stereo signal.

21. The method as claimed in claim 20, wherein:

(a) the circuit being configured to provide the gain factor $P_M''$ equal to the reciprocal value of the result which is calculated from the squared polar interval for the angle β, divided by the squared sine of β multiplied by 4, plus the squared polar interval for the angle ϕ, plus the product of the polar interval for the angle β, the polar interval for the angle ϕ and the sine of ϕ divided by the sine of β;

(b) the gain factor P(α)' equal to the product of the gain factor $P_M''$ described in (a) and the gain factor P(α) described in claim 2(a);

(c) the circuit being configured to provide a delay time L(α) equal to the negative polar interval for the angle α, divided by the doubled sine of α, plus the square root of the result which is calculated from the squared polar interval for the angle α, divided by the squared sine of α multiplied by 4, plus the squared polar interval for the angle ϕ, minus the product of the polar interval for the angle α, the polar interval for the angle ϕ and the sine of ϕ divided by the sine of α;

(d) the circuit being configured to provide a delay time L(β) equal to the negative polar interval for the angle β, divided by the doubled sine of β, plus the square root of the result which is calculated from the squared polar interval for the angle β, divided by the squared sine of β multiplied by 4, plus the squared polar interval for the angle ϕ, plus the product of the polar interval for the angle β, the polar interval for the angle ϕ and the sine of ϕ divided by the sine of β.

22. The method as claimed in claim 21, including an additional transformation of the respectively obtained stereo signal into stereophonic signals which are reproduced by more than two loudspeakers.

23. The method as claimed in claim 20, including an additional transformation of the respectively obtained stereo signal into stereophonic signals which are reproduced by more than two loudspeakers.

24. The method as claimed in claim 13, including an additional transformation of the respectively obtained stereo signal into stereophonic signals which are reproduced by more than two loudspeakers.

* * * * *

UNITED STATES PATENT AND TRADEMARK OFFICE

CERTIFICATE OF CORRECTION

PATENT NO. : 8,638,947 B2
APPLICATION NO. : 12/946008
DATED : January 28, 2014
INVENTOR(S) : Clemens Par It is certified that error appears in the above-identified patent and that said Letters Patent is hereby corrected as shown below:

On the Title Page

Item (57), please replace the last sentence of the abstract,

"This is provided for the situation of fictitious opening angles α+α which are asymmetric with respect to the principal axis of the monophonic audio signal to be stereophonized." with --This is provided for the situation of fictitious opening angles α+ß which are asymmetric with respect to the principal axis of the monophonic audio signal to be stereophonized.--

In the Specification

Column 7, line 57, replace "a fictitious opening angle α+α" with --a fictitious opening angle α+ß--

Signed and Sealed this
Twentieth Day of May, 2014

Michelle K. Lee

Michelle K. Lee
*Deputy Director of the United States Patent and Trademark Office*